US011473589B2

(12) United States Patent
Volk et al.

(10) Patent No.: US 11,473,589 B2
(45) Date of Patent: Oct. 18, 2022

(54) IMPELLER ASSEMBLIES AND METHOD OF MAKING

(71) Applicant: Franklin Electric Co., Inc., Fort Wayne, IN (US)

(72) Inventors: James J. Volk, Fort Wayne, IN (US); Jose Gabriel Davila Rangel, Fort Wayne, IN (US); Baoning Zhang, Fort Wayne, IN (US); Jeffrey Alan Roussel, Fort Wayne, IN (US); Jess Adam Decker, Markle, IN (US); Bruce Edward Schubert, Fort Wayne, IN (US)

(73) Assignee: Franklin Electric Co., Inc., Fort Wayne, IN (US)

( * ) Notice: Subject to any disclaimer, the term of this patent is extended or adjusted under 35 U.S.C. 154(b) by 448 days.

(21) Appl. No.: 16/409,252

(22) Filed: May 10, 2019

(65) Prior Publication Data

US 2019/0353179 A1 Nov. 21, 2019

Related U.S. Application Data

(60) Provisional application No. 62/673,509, filed on May 18, 2018.

(51) Int. Cl.
*F04D 29/34* (2006.01)
*F04D 29/66* (2006.01)
(Continued)

(52) U.S. Cl.
CPC ..... *F04D 29/329* (2013.01); *F04D 13/06* (2013.01); *F04D 29/2222* (2013.01); *F04D 29/242* (2013.01); *F04D 29/34* (2013.01); *F04D 29/666* (2013.01); *F04D 1/06* (2013.01); *F04D 13/08* (2013.01); *F04D 17/122* (2013.01); *F04D 25/06* (2013.01)

(58) Field of Classification Search
CPC ..... F04D 29/242; F04D 29/28; F04D 29/284; F04D 29/286; F04D 29/30; F04D 29/34; F04D 1/06; F04D 13/10
See application file for complete search history.

(56) References Cited

U.S. PATENT DOCUMENTS 2,453,524 A * 11/1948 McMahan ..... F04D 29/444 415/208.4
6,419,450 B1 * 7/2002 Lum ..... F04D 29/2222 415/131
(Continued)

FOREIGN PATENT DOCUMENTS

JP S59103998 A 6/1984
JP 2013213441 A * 10/2013
(Continued)

OTHER PUBLICATIONS

JP-2013213441-A Machine Translation. Accessed EPO website Sep. 15, 2021. 6 Pages. (Year: 2021).*

*Primary Examiner* — Richard A Edgar
(74) *Attorney, Agent, or Firm* — Harness, Dickey & Pierce, P.L.C.

(57) ABSTRACT

A double curvature blade for a portion of system. The system may include a pump, such as a submersible pump. The pump may include a multiple or single stage pump. The pump may be powered by a selected motor.

23 Claims, 22 Drawing Sheets

(51) Int. Cl.

| | |
|---|---|
| ***F04D 29/24*** | (2006.01) |
| ***F04D 13/06*** | (2006.01) |
| ***F04D 29/22*** | (2006.01) |
| ***F04D 29/32*** | (2006.01) |
| *F04D 17/12* | (2006.01) |
| *F04D 25/06* | (2006.01) |
| *F04D 13/08* | (2006.01) |
| *F04D 1/06* | (2006.01) |

(56) References Cited

U.S. PATENT DOCUMENTS

| | | | | |
|---|---|---|---|---|
| 6,488,472 | B1 * | 12/2002 | Miyazawa | F04D 29/662 416/237 |
| 7,290,984 | B2 | 11/2007 | Volk | |
| 7,628,586 | B2 * | 12/2009 | Feher | B23P 15/006 415/170.1 |
| 8,793,872 | B2 | 8/2014 | Adachi et al. | |
| 8,998,581 | B2 * | 4/2015 | Giovannetti | F04D 29/284 416/180 |
| 9,086,075 | B2 | 7/2015 | Miller et al. | |
| 9,243,646 | B2 | 1/2016 | Boll | |
| 9,611,864 | B2 * | 4/2017 | Childe | F04D 29/624 |
| 9,624,930 | B2 * | 4/2017 | Gahlot | F04D 7/045 |
| 10,016,808 | B2 | 7/2018 | Vestermark Vad | |
| 2008/0199319 | A1 | 8/2008 | Mause et al. | |
| 2009/0175729 | A1 * | 7/2009 | Sun | F04D 29/329 416/244 R |
| 2009/0297344 | A1 * | 12/2009 | Hill | F01D 5/048 415/208.1 |
| 2012/0282119 | A1 * | 11/2012 | Floyd | F04D 13/10 417/312 |
| 2015/0030457 | A1 | 1/2015 | Yamamoto et al. | |
| 2017/0260997 | A1 * | 9/2017 | Mola | F01D 5/04 |
| 2017/0370373 | A1 | 12/2017 | Rausch | |
| 2019/0226497 | A1 * | 7/2019 | Maeda | F04D 29/2222 |

FOREIGN PATENT DOCUMENTS

| | | | | |
|---|---|---|---|---|
| KR | 100438277 | B1 * | 7/2004 | |
| KR | 20160015902 | A * | 2/2016 | |
| WO | WO-9506821 | A1 * | 3/1995 | F04D 29/023 |
| WO | WO-2014038949 | A1 * | 3/2014 | F03B 3/121 |
| WO | WO-2016190749 | A1 * | 12/2016 | F03B 3/12 |

* cited by examiner

IMPELLER ASSEMBLIES AND METHOD OF MAKING

FIELD

The present disclosure relates to rotatable machinery, and particularly to submersible pumps or other centrifugal pumps.

BACKGROUND

Pumps may be used to move various materials, such as generally fluid materials, at a selected rate and/or pressure. In various configurations, pumps may be connected at a central spindle or axle where vanes are rotated through a connection to the axle. The rotation of the vanes may cause the movement of the fluid.

The fluid may include selected materials such as liquid or gasses. Liquid fluids may include water, hydrocarbons, or other appropriate liquids. Generally the operation of a pump may be performed and/or augmented to achieve a selected flow rate and/or head pressure.

Generally, a molded impeller, particularly a plastic molded impeller, may include a vane that has no curvature and/or a single curvature. The single curvature in a molded configuration is generally created and/or allowed due to the movement of two molding pieces away from each other in a molding process. Generally in an injection molded configuration or process, two portions of a mold may come together and a moldable material is injected into the mold. After a selected period of time and/or process, the mold is separated and the molded pieces removed.

SUMMARY

This section provides a general summary of the disclosure, and is not a comprehensive disclosure of its full scope or all of its features.

Disclosed is a design and process technique that allows the manufacturability of a double curvature blade or vane for an impeller within the simple two-plate injection process. A blade or blade member may also be referred to as a vane and may be incorporated into a blade component. In various embodiments, the double curvature may be an optimal double curvature for a selected process, material, etc. For example, pumping or flowing a viscous liquid may be optimized at a selected shape as opposed to a gas.

Accordingly, disclosed is a selected manufacturing process, which allows a molding of double curvature blade or blade assembly. In various embodiments, the process includes molding an impeller in three main components: shroud, blades, and hub. The three components may be assembled post molding for manufacturing of an impeller. In various embodiments, an impeller may include less than three components such as only blades and/or only blades and one of a hub or a shroud. It is further understood, that various components may be given different nomenclature, such as (i) a shroud or inlet shroud; (ii) a blade or vane; and (iii) a hub or outlet shroud. The various components, as discussed herein, may be formed and assembled in various embodiments.

In various embodiments, the double curvature of the blade may allow or create overlap between selected blades, such as blades that are near each other, including blades that are adjacent or in sequence relative to one another. The number of blades may be further selected based upon the material to be moved and/or other operational parameters of the pump.

Accordingly, the number of blades (e.g. the number of individual blades in a blade component) may be an even number or an odd number.

In various embodiments, including an even number of overlapping blades is disclosed. In such a configuration of the blade component, two identical blade sets may be molded. In this configuration, the impeller may be formed with four molded components: shroud, two identical blade sets, and a hub.

In various embodiments, including an odd number of overlapping blades is disclosed. In such a configuration of the blade component, two non-identical blade sets may be molded. In this configuration, the impeller may be formed with four molded components: shroud, two non-identical blade sets, and a hub.

In various embodiments, including extremely overlapping individual blades the impeller may be divided into further components. In various embodiments, three or more molded blade components may be formed. Thus, the impeller may be formed with about 6 to 10 molded components: a shroud, a selected number of blade components (e.g. 3 to 10 identical or non-blades), a hub, and selectively a cap.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 12:
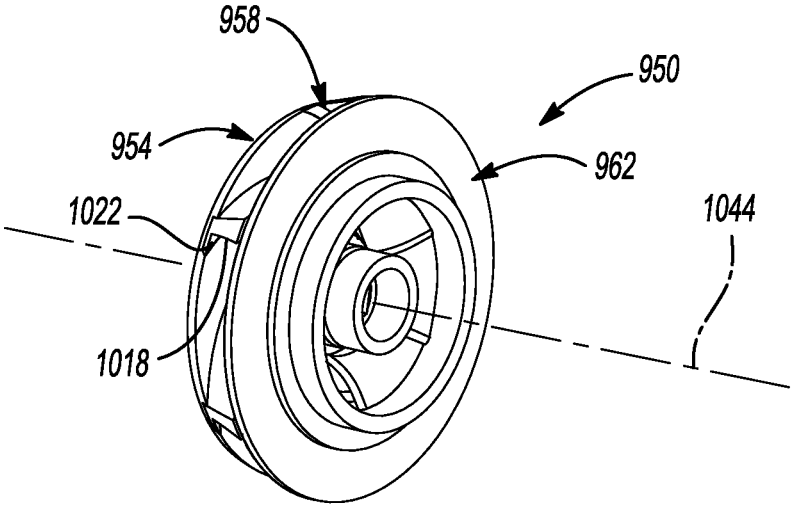
FIG. 12 is an impeller assembly, according to various embodiments.
Figure 13:
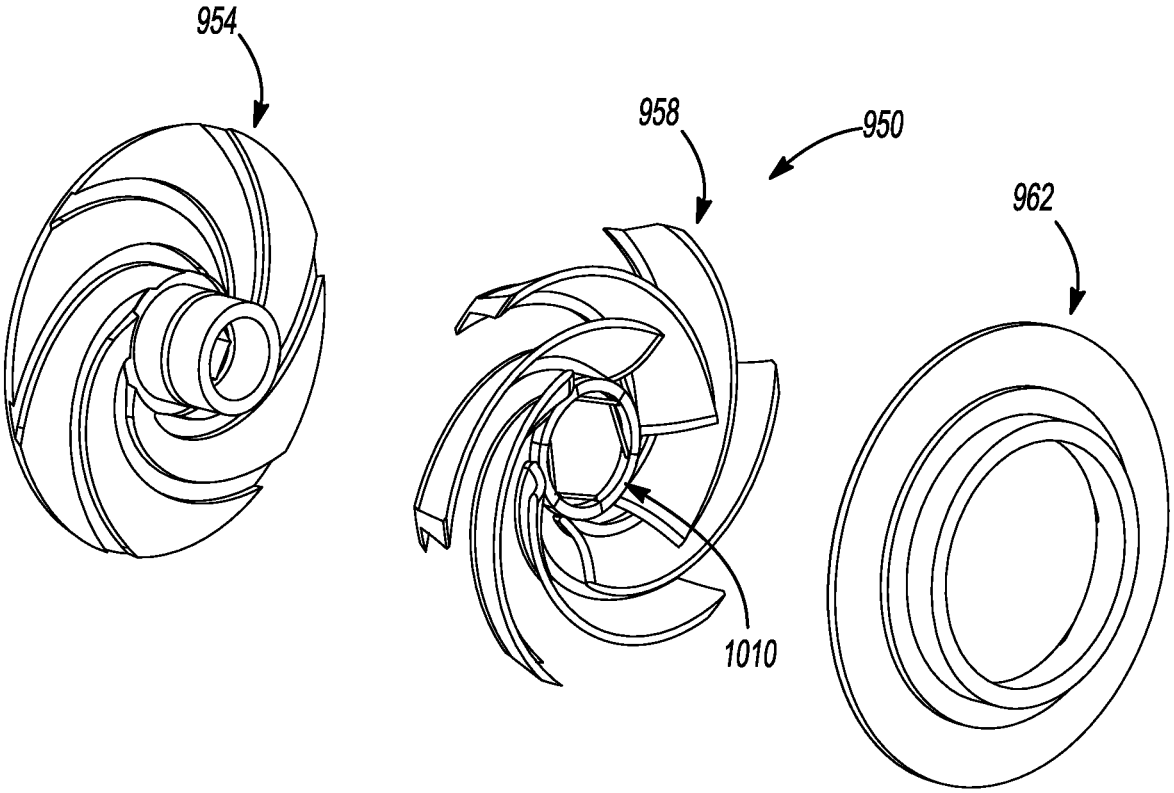
Figure 14:
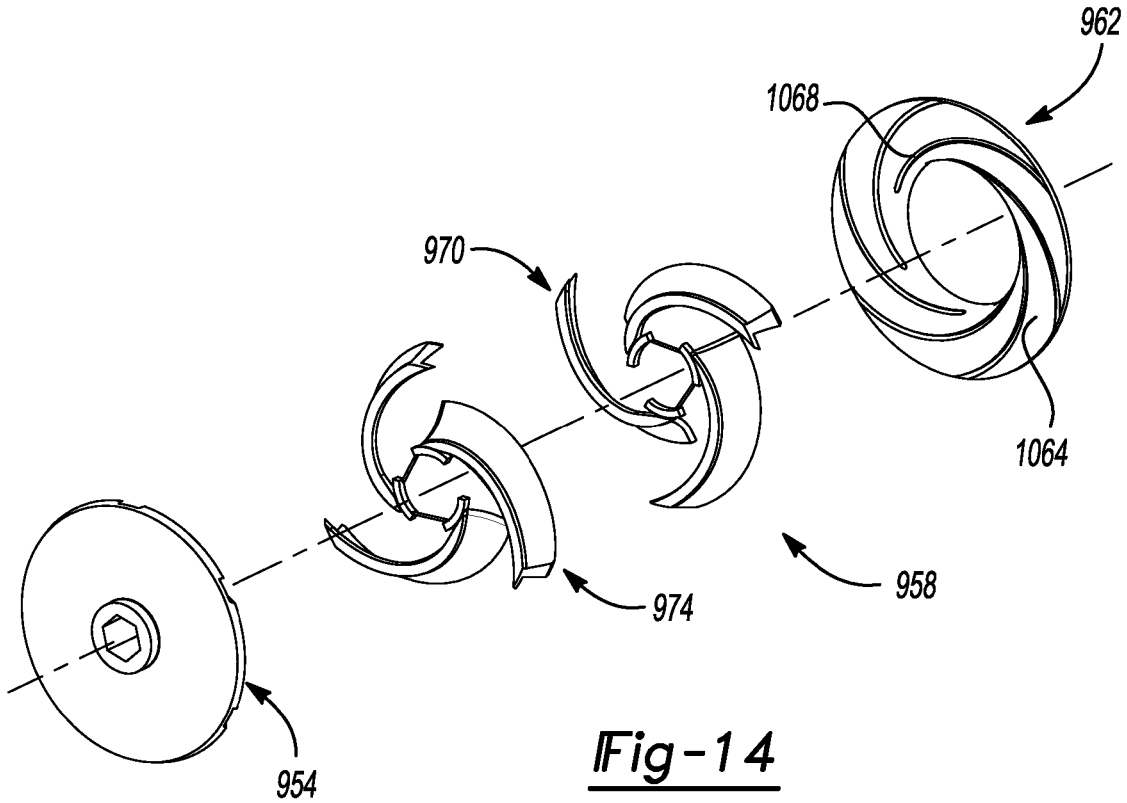
Figure 15:
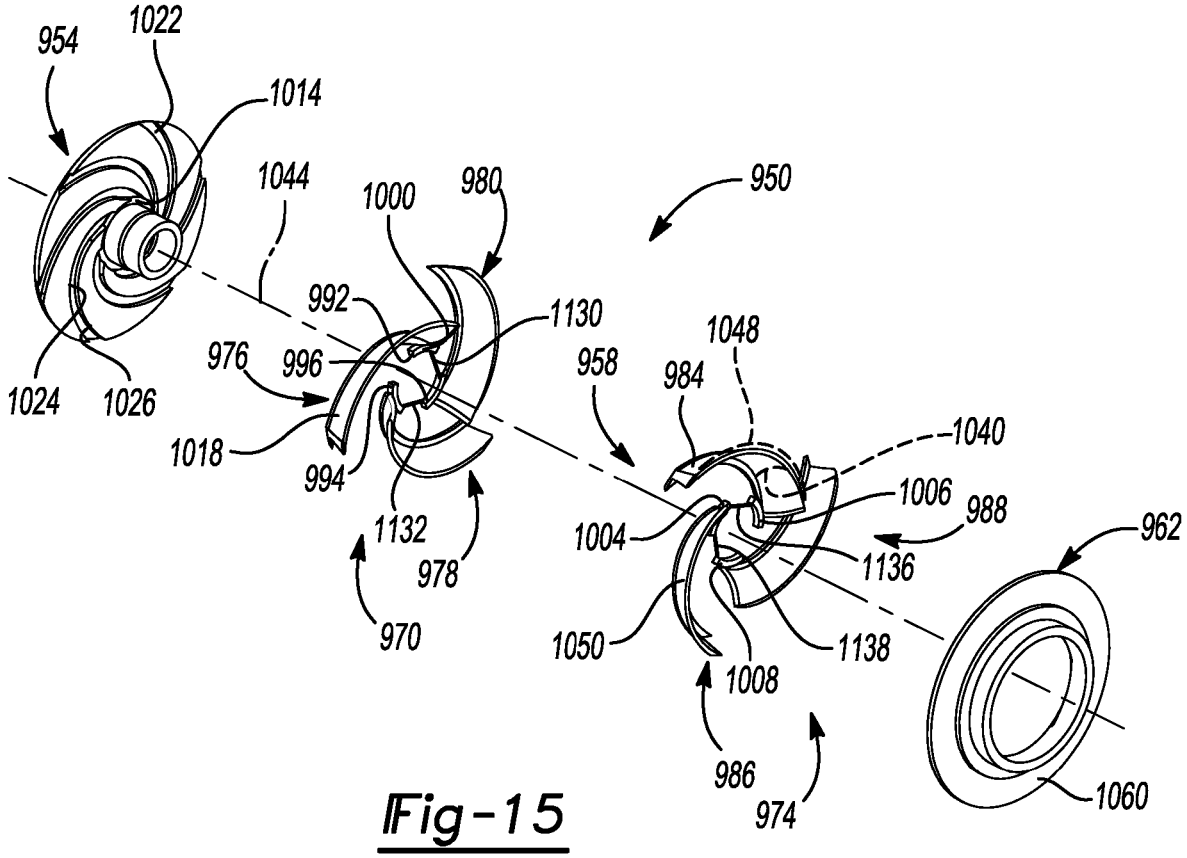
Figure 16:
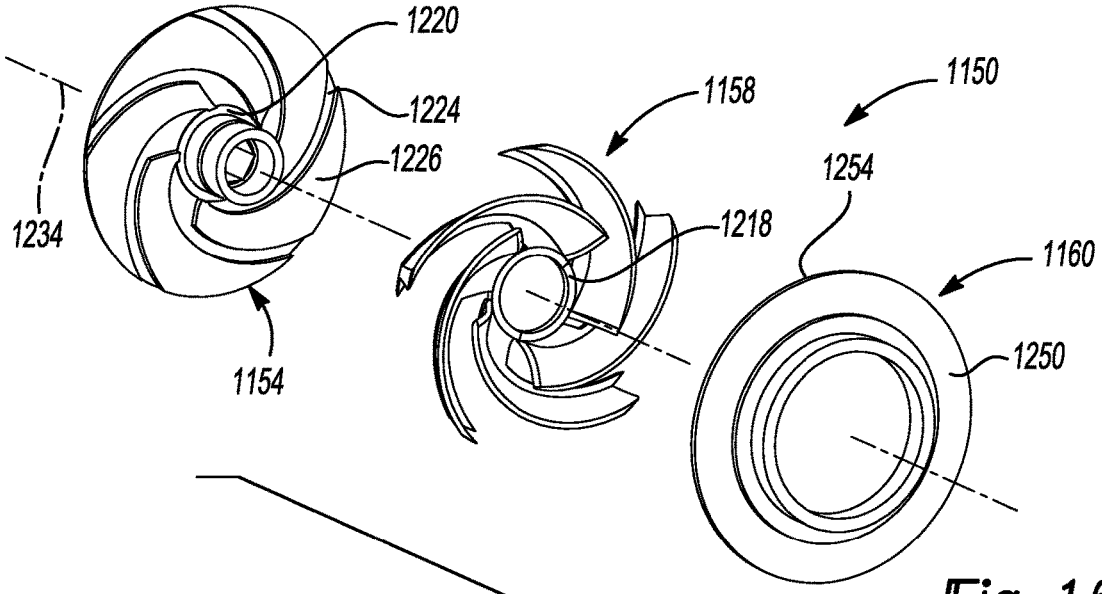
Figure 17:
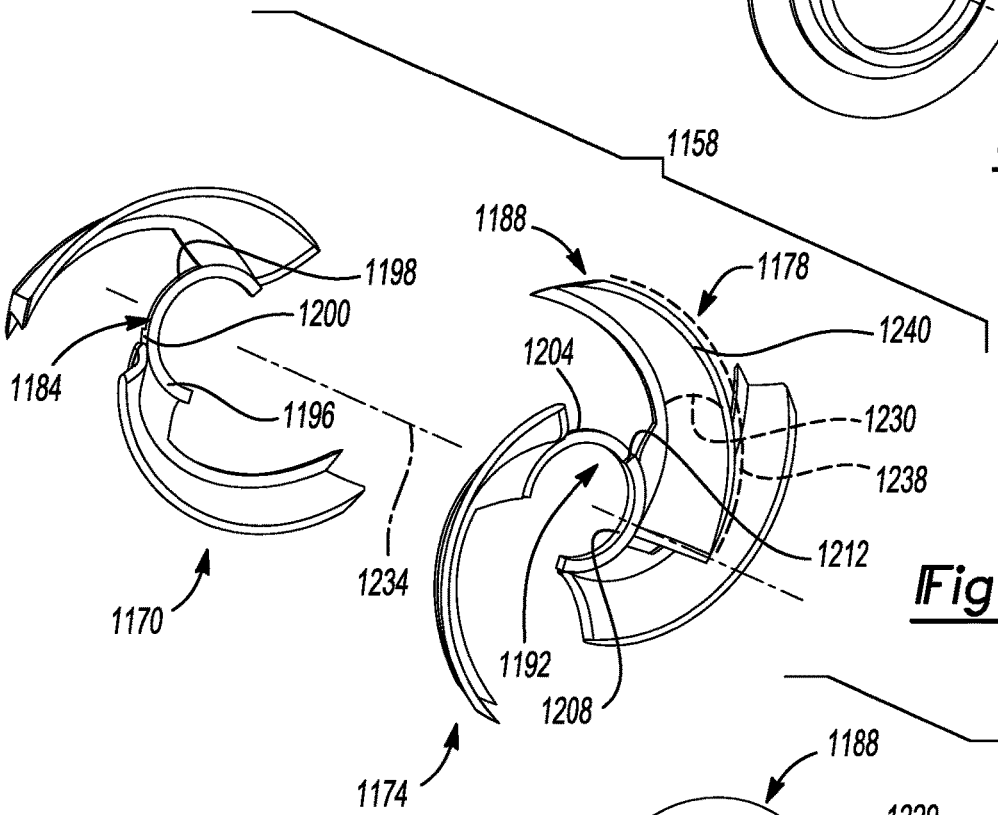
Figure 18:
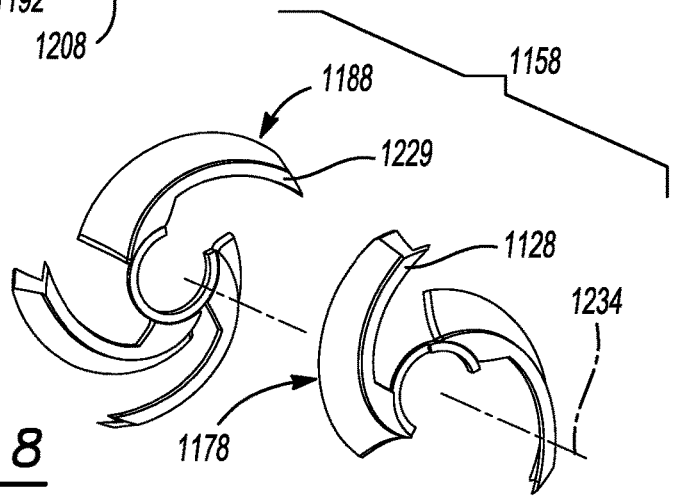
Figure 19:
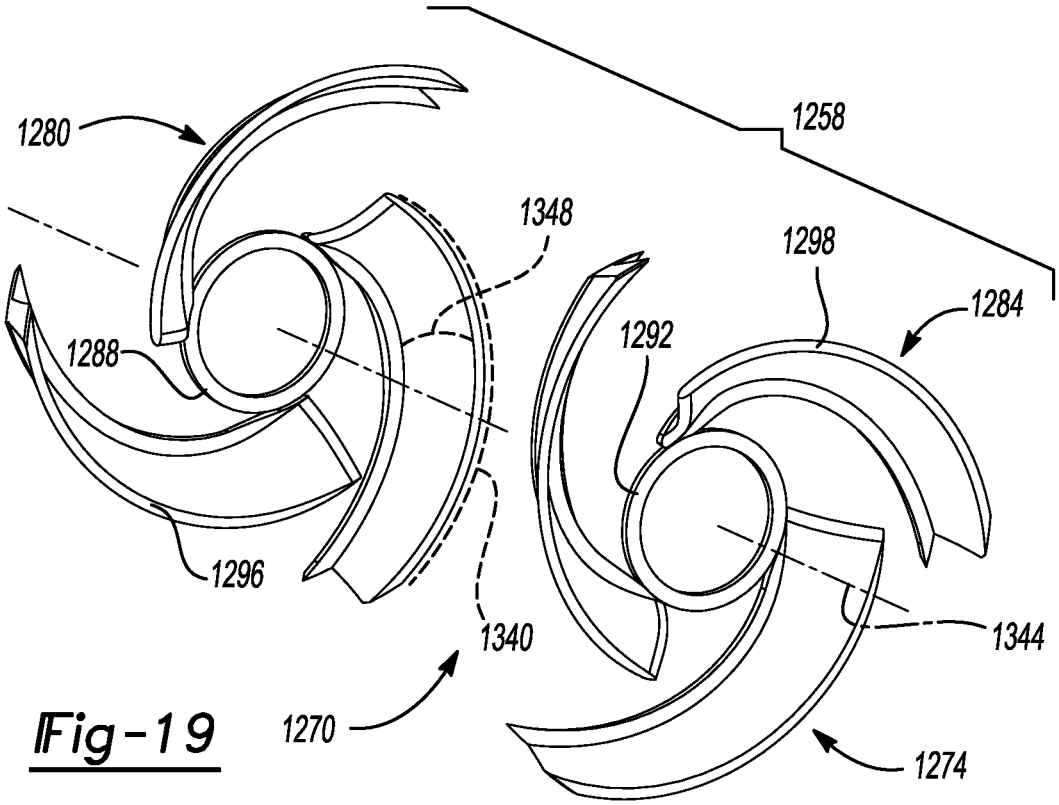
Figure 20:
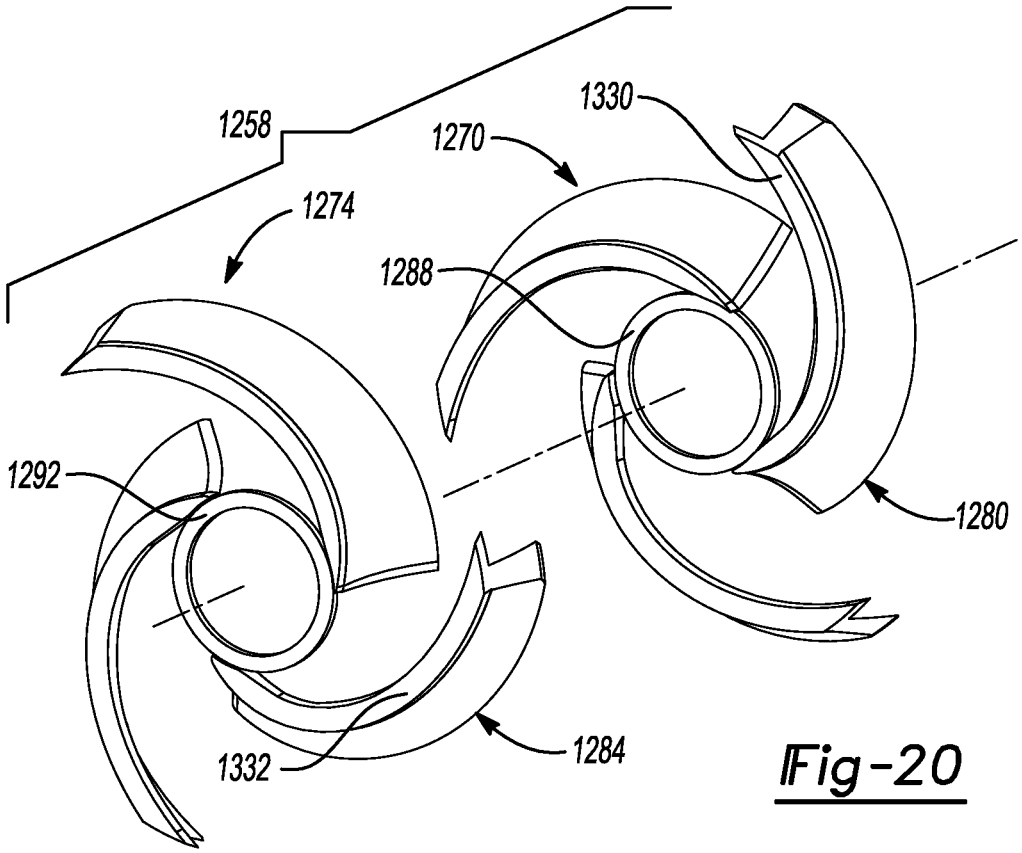
Figure 21:
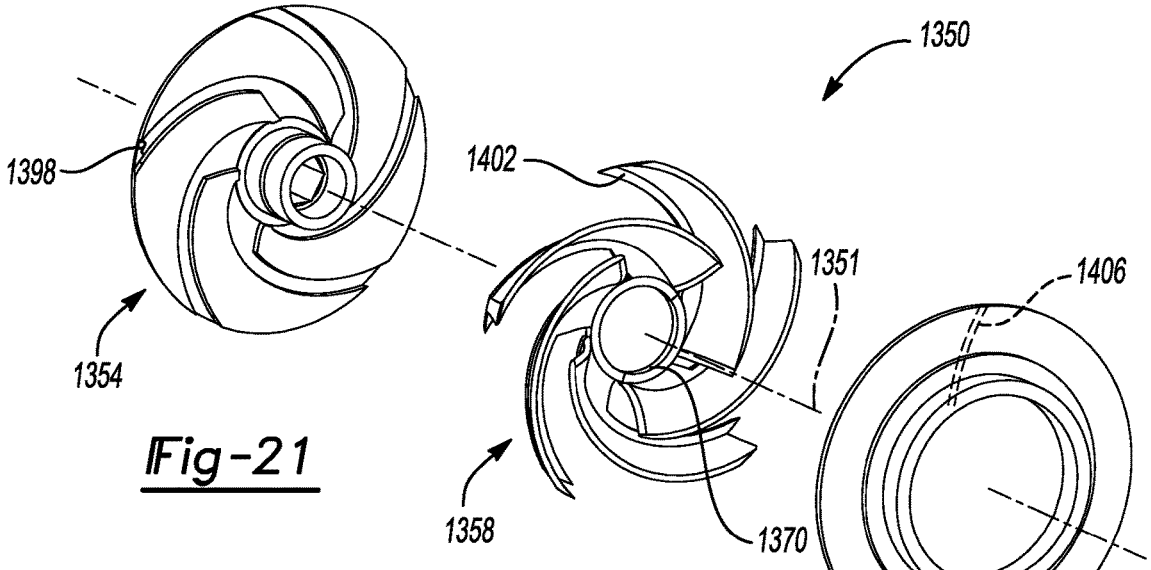
Figure 22:
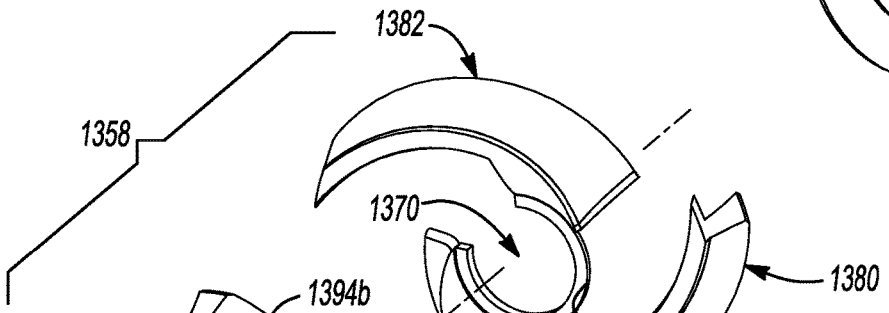
Figure 23:
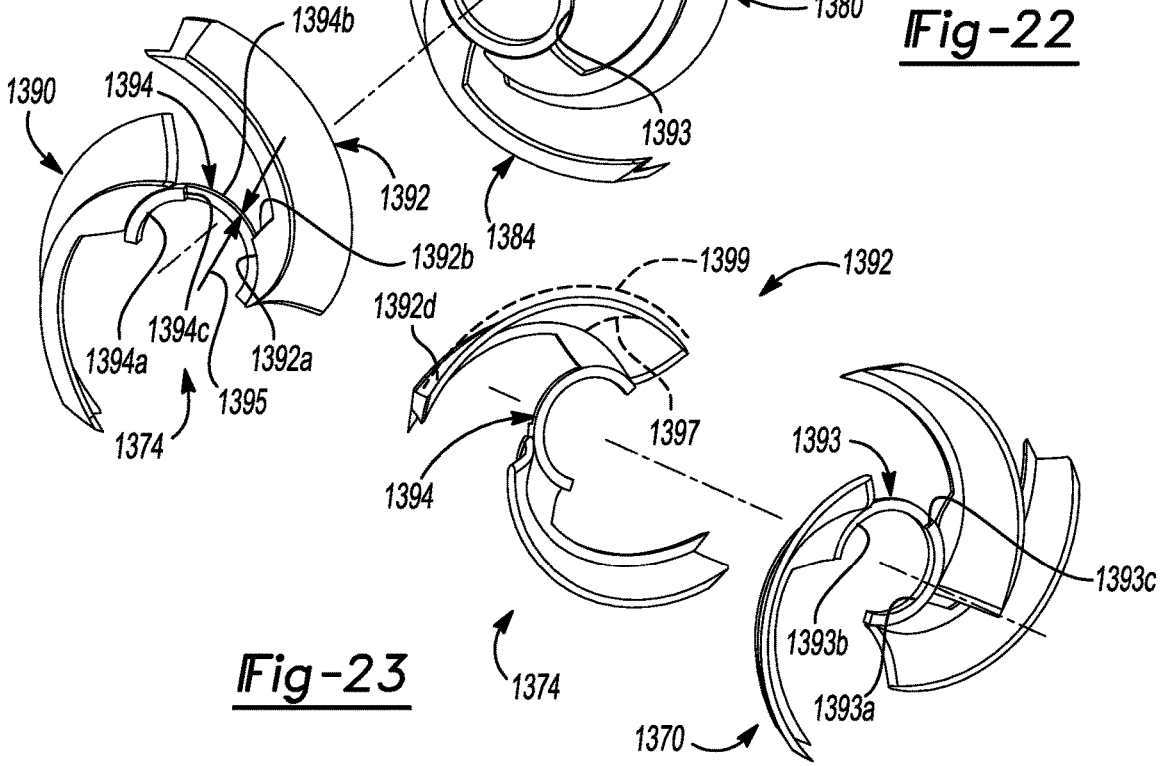
Figure 24:
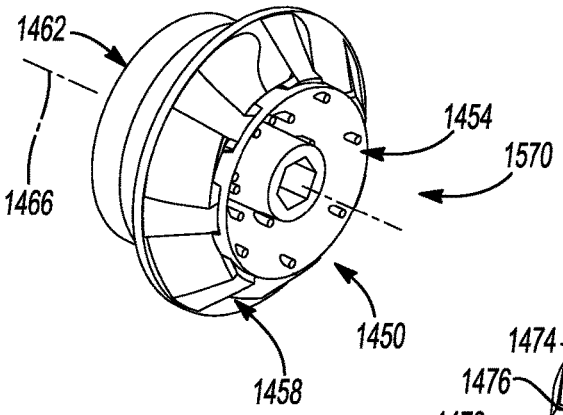
Figure 25:
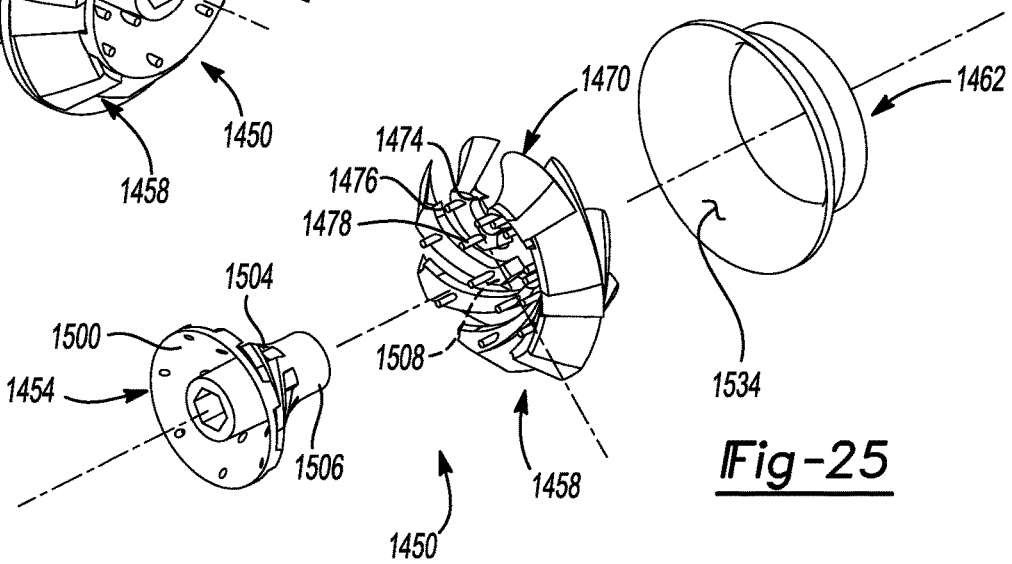
Figure 26:
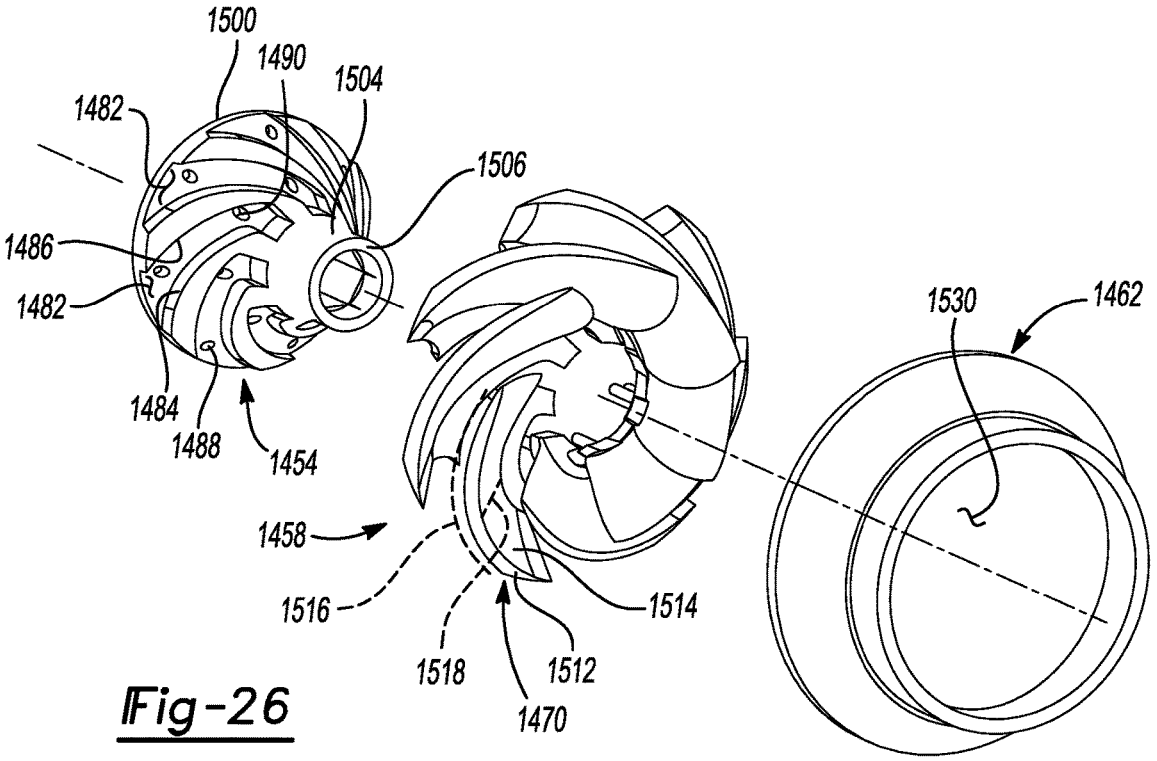
Figure 27:
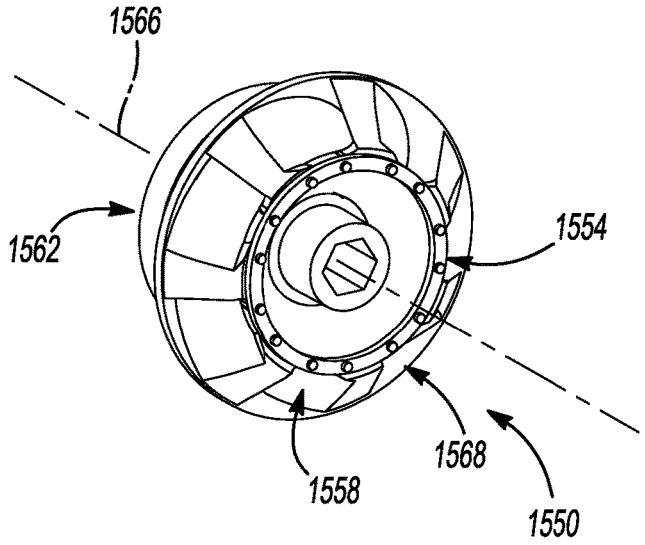
Figure 28:
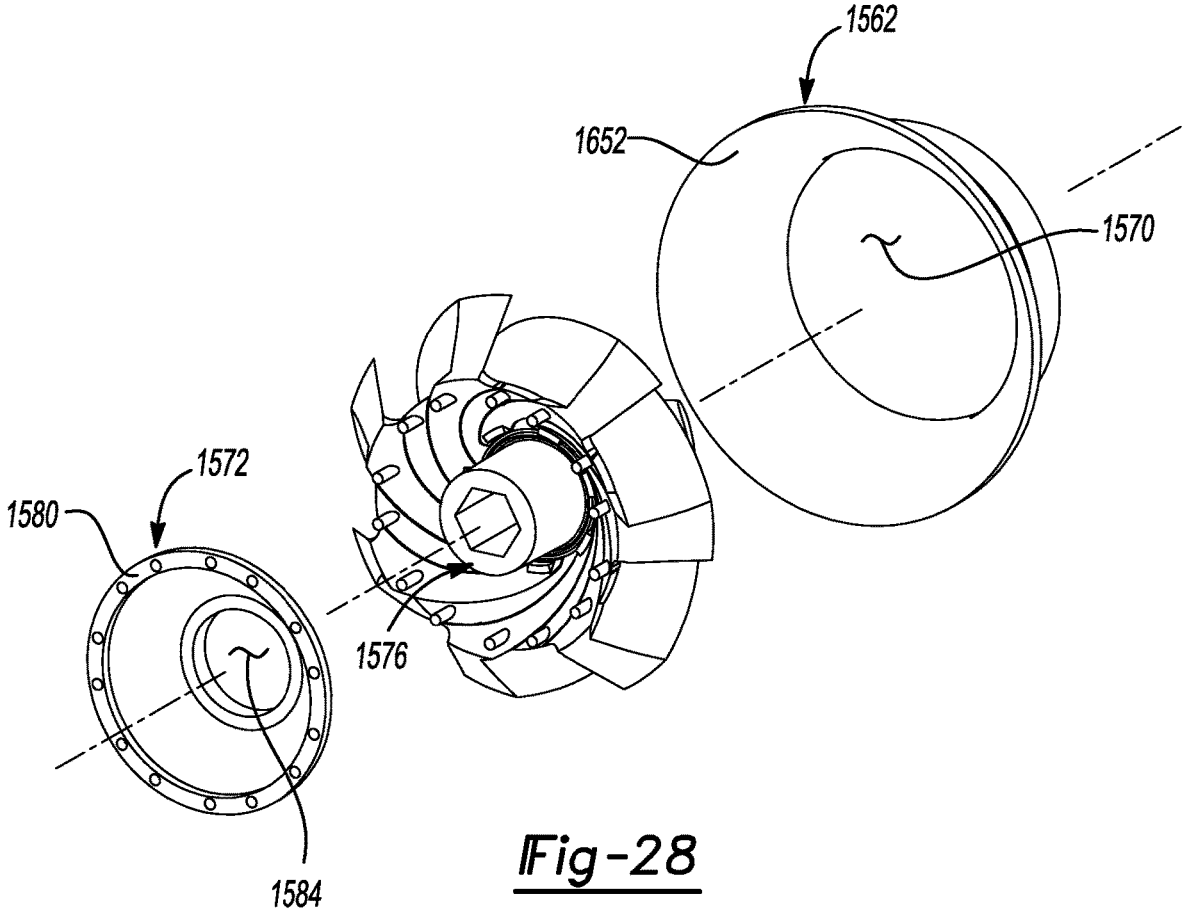
Figure 29:
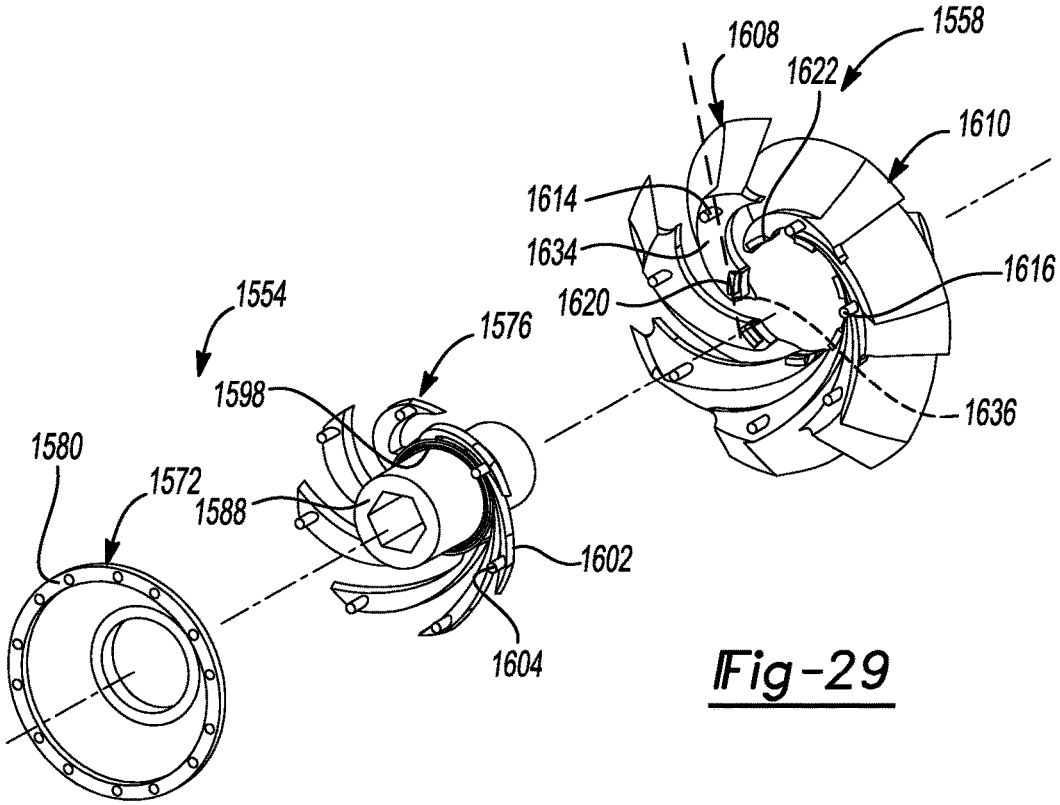
Figure 30:
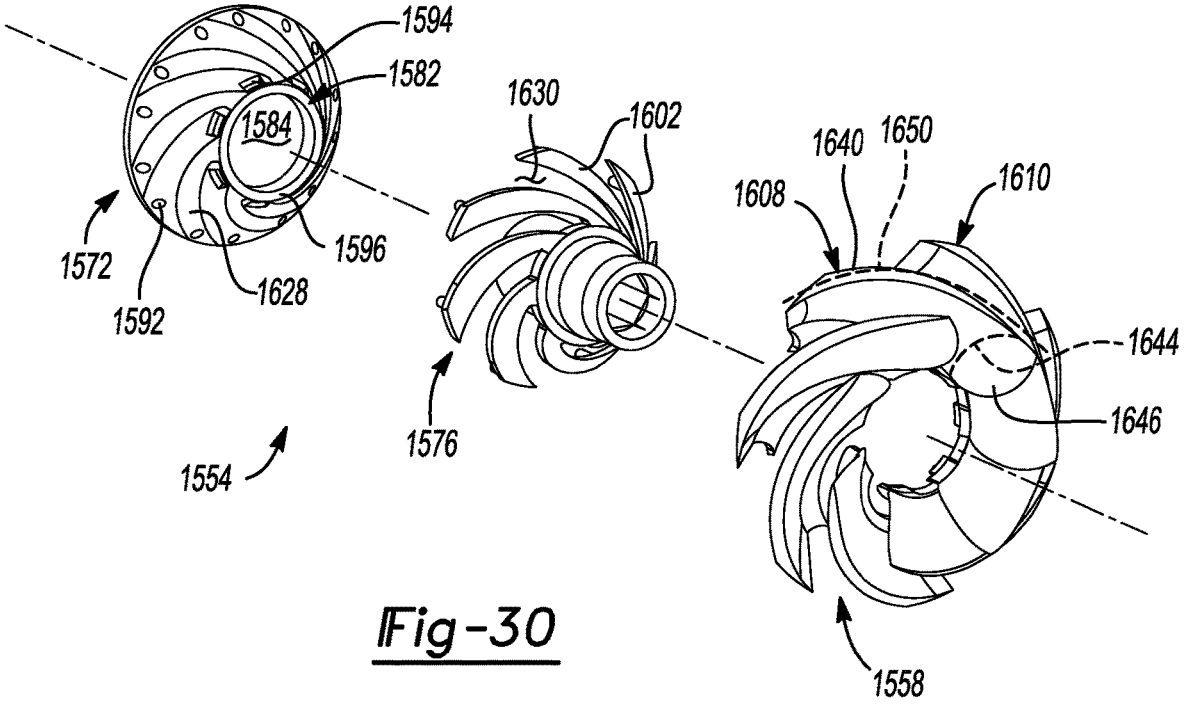
Figure 31:
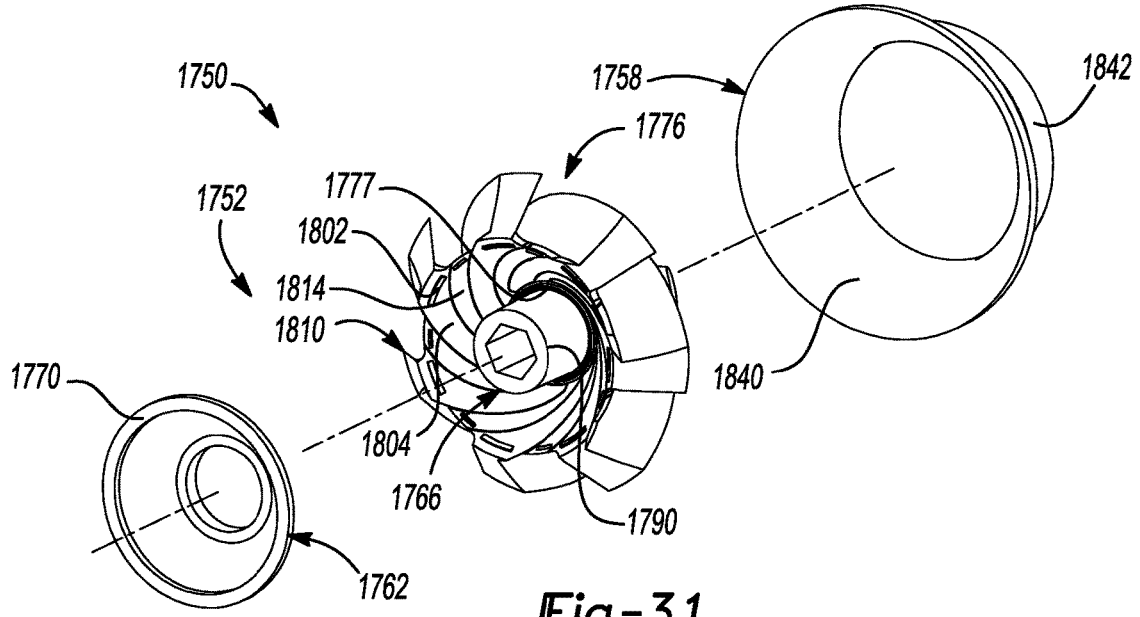
Figure 32:
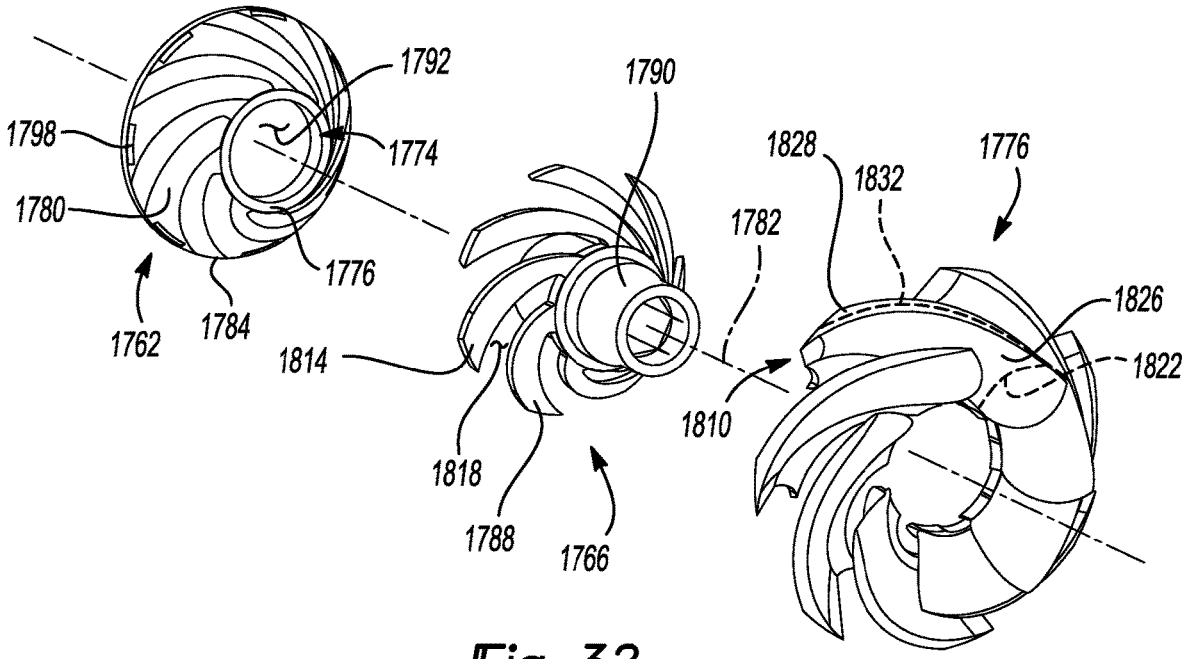
Figure 33:
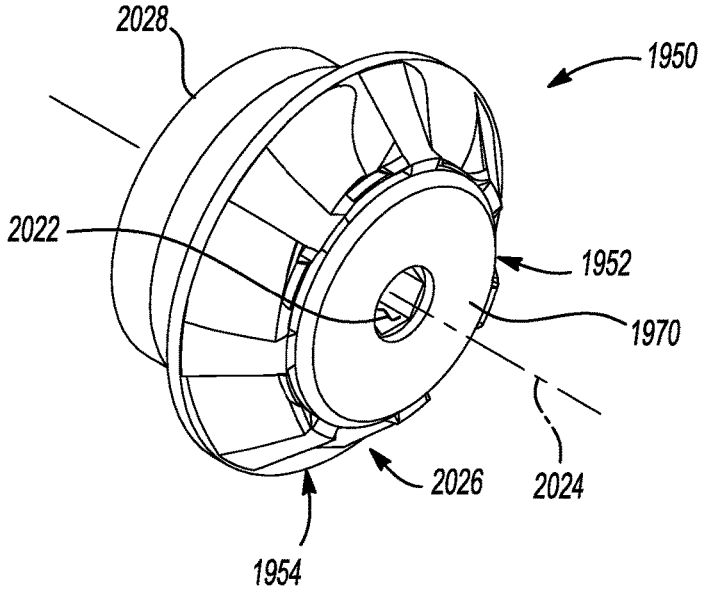
Figure 34:
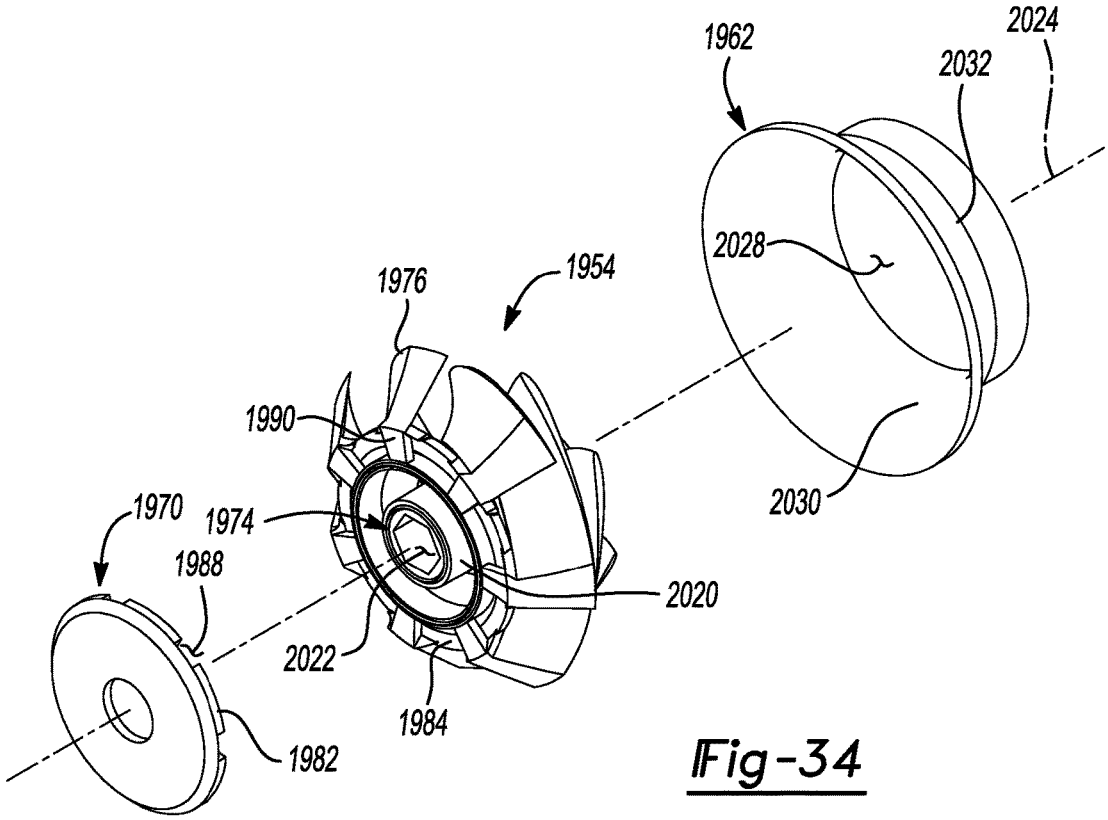
Figure 35:
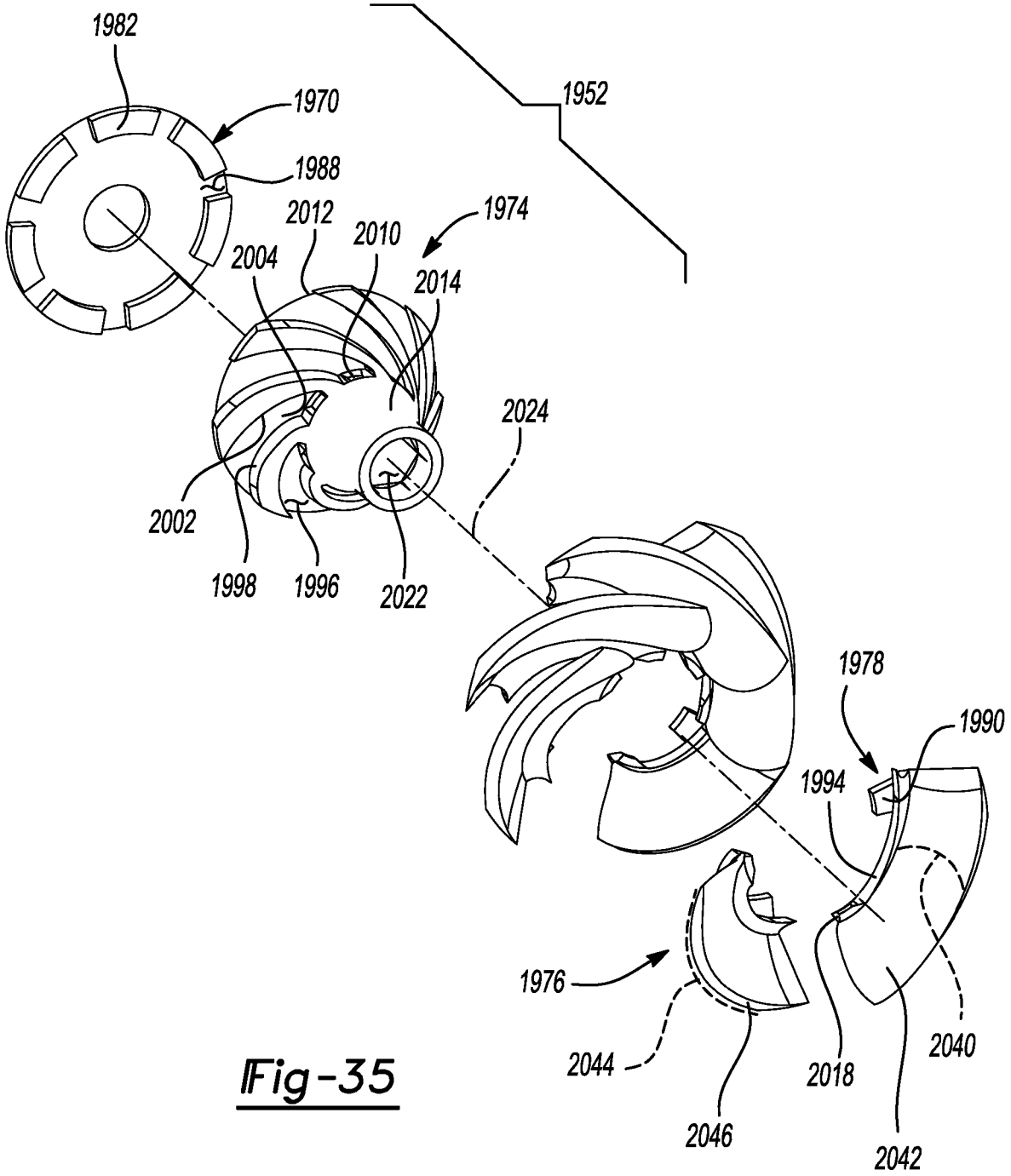
Figure 36:
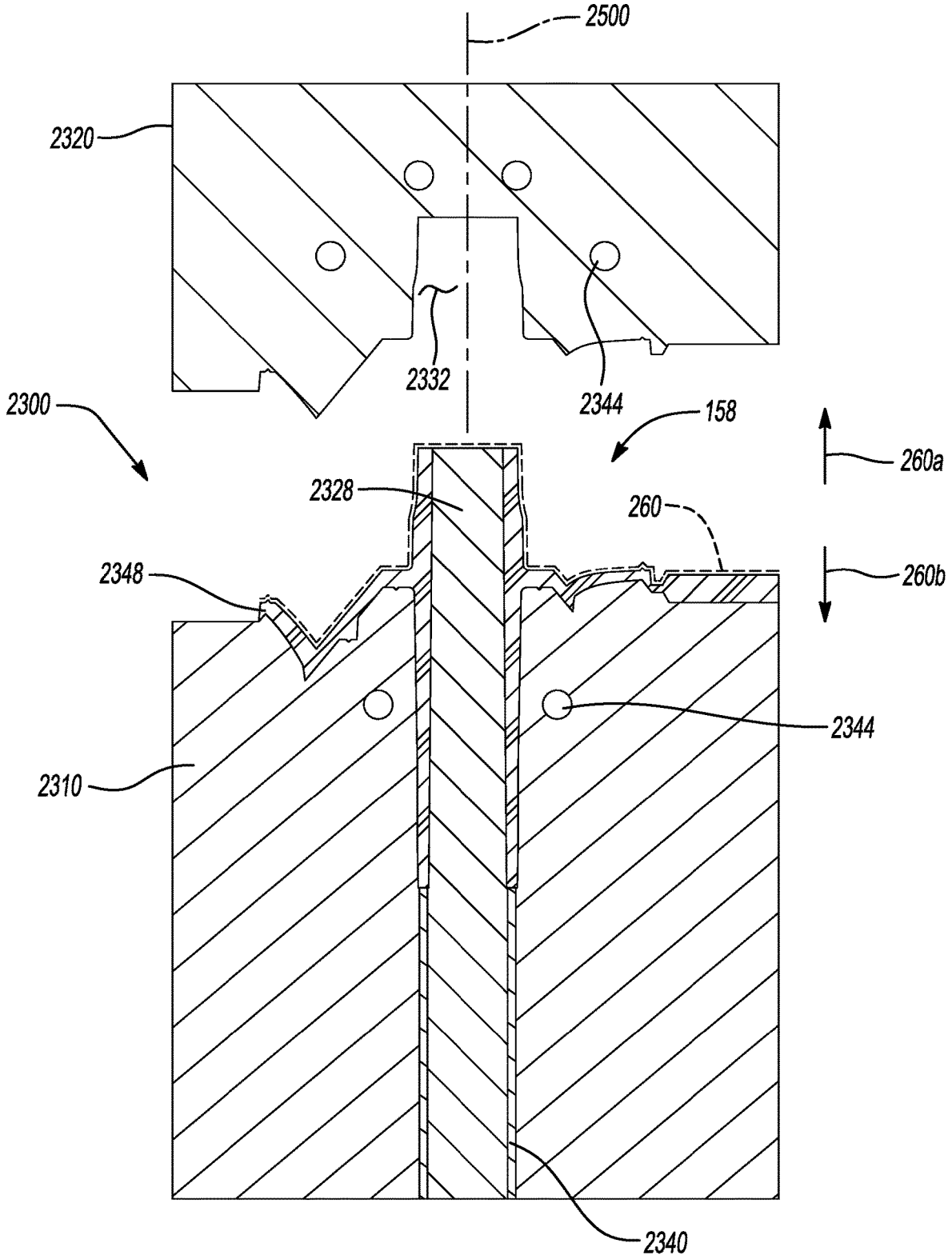

FIG. 13, FIG. 14, and FIG. 15 are an exploded view of the impeller assembly of FIG. 12;

FIG. 16 is an exploded view of an impeller assembly, according to various embodiments;

FIG. 17 and FIG. 18 are an exploded view of a blade component, according to various embodiments;

FIG. 19 and FIG. 20 are an exploded view of a blade component, according to various embodiments;

FIG. 21 is an exploded view of an impeller assembly, according to various embodiments;

FIG. 22 and FIG. 23 are an exploded view of a blade component, according to various embodiments;

FIG. 24 is an assembled view of an impeller, according to various embodiments;

FIG. 25 and FIG. 26 are exploded views of the impeller assembly of FIG. 24;

FIG. 27 is an assembled view of an impeller assembly, according to various embodiments;

FIG. 28, FIG. 29, and FIG. 30 are an exploded view of the impeller assembly of FIG. 27;

FIG. 31 and FIG. 32 are an exploded view of an impeller assembly, according to various embodiments;

FIG. 33 is an assembled view of an impeller assembly, according to various embodiments;

FIG. 34 and FIG. 35 are exploded views of an impeller assembly, according to FIG. 33; and FIG. 36 is a simplified cross-sectional view of a mold assembly.

DETAILED DESCRIPTION

Example embodiments will now be described more fully with reference to the accompanying drawings.

A centrifugal multi-stage pump or other centrifugal pump is composed of two main hydraulic components, impellers and diffusers. The two components transform a rotational kinetic energy in to hydrodynamic energy of the fluid that is being transported. Generally, the impellers include a portion that rotates. The rotating portion may include blades that act on the fluid to create the hydrodynamic energy. Generally, a blade component may include a plurality of individual blades. In various embodiments, a blade may also be referred to as a vane, fluid contacting blade, etc.

The disclosed components may be incorporates into a multiple stage pump. The multiple stage pump may include a plurality of stages including impellers and diffusers. Generally, the disclosed portions allow for at least higher hydraulic efficiency, stronger structural support for torque loads, tighter leakage control, and additional robustness to the joints.

Figure 1:
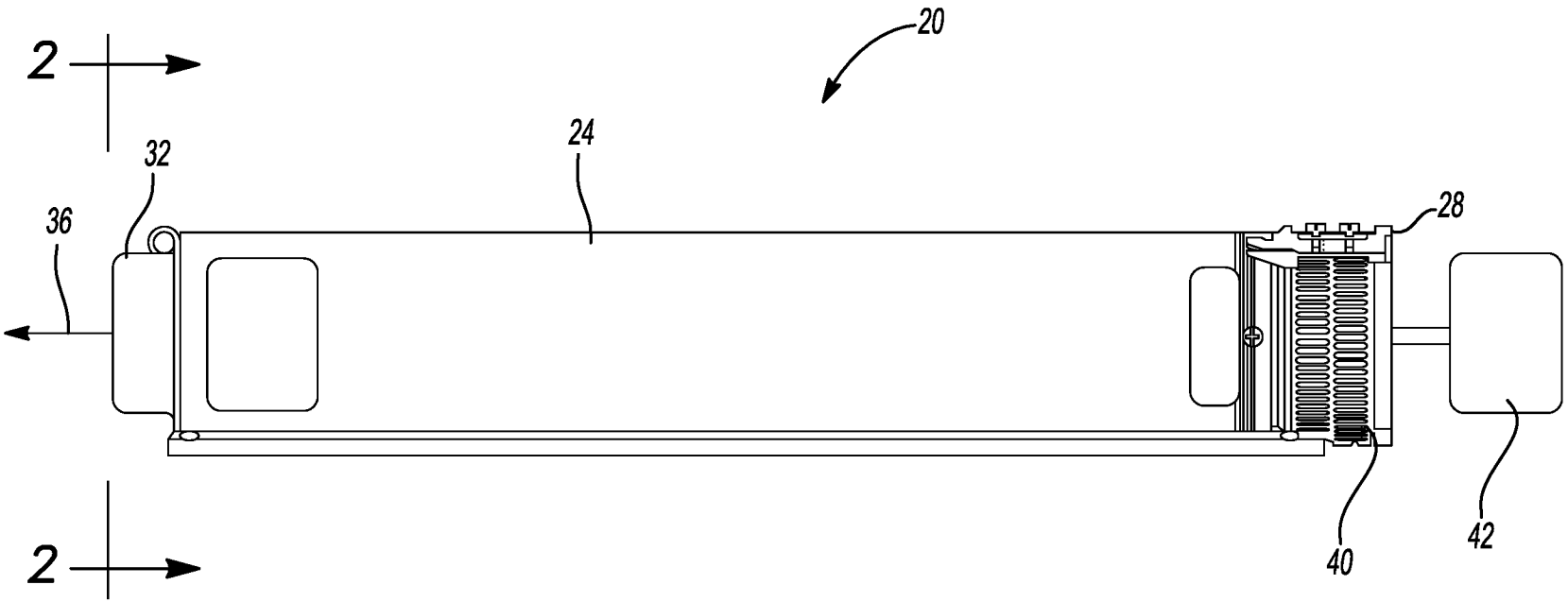
FIG. 1 is an environmental view of a multi-stage pump assembly.
Figure 2:
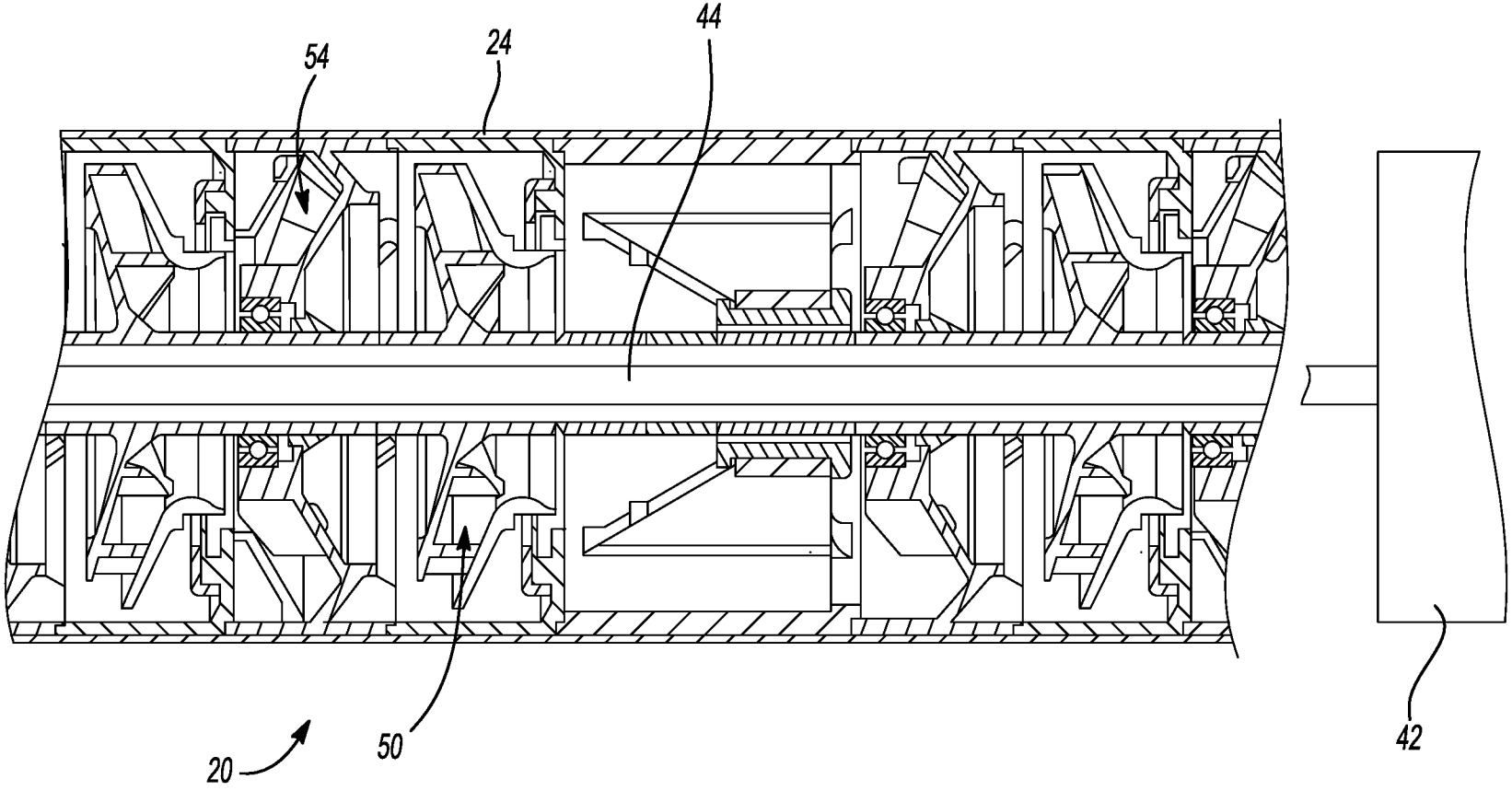
FIG. 2 is a cross sectional view of the multi-stage pump assembly of FIG. 1.

With initial reference to FIG. 1 and FIG. 2, a pump assembly 20 is illustrated. The pump assembly 20 may include various portions such as an exterior casing 24. The exterior casing may extend from a first end 28 to a second end 32. The second end 32 may be an outlet end such that fluid will flow through the pump assembly 20 generally in the direction of arrow 36. At the first end 28 may be a screen or opening portion 40. A motor 42 may be positioned at or near the first end 28 and engage a central shaft 44. The central shaft 44 may be rotated by the motor in a selected direction, such as generally around a longitudinal axis of the shaft 44.

In a multi-stage pump assembly, including a centrifugal pump, two main hydraulic components are generally included including an impeller 50 and a diffuser 54. The impeller 50 may be fixed to the shaft assembly 44 such that as the shaft assembly 44 rotates the impeller 50 also rotates around a longitudinal axis of the shaft assembly 44. The diffuser 54 is generally fixed relative to the case 24 and is generally fixed (e.g. non-moving) relative to the shaft assembly 44. Thus, upon operation of the motor assembly, the shaft 44 may rotate thereby rotating the impellers, including the impeller 50. Rotation of the impeller 50 may draw fluid through the screen 40 thereby drawing fluid generally in the direction of arrow 36. Due to the hydraulic forces caused by the impeller 50, the fluid may then move generally in the direction of arrow 36 along the length of the pump assembly 20. In this manner, the pump assembly 20 may be positioned in a selected location. Selected locations may be below a grade or surface level, such as in a bore, bore hole, well, or a sump. The pump assembly 20 may draw the fluid to the screen portion 40 and through the pump assembly 20. As discussed herein, the impeller stage or assembly 50 may be provided in various embodiments, and/or a plurality of embodiments, within the pump assembly 20. The diffuser assembly 54 may also be provided according to various embodiments, as also discussed herein. It is understood that the pump assembly 20 may include any selected number of the stages, various examples including one stage, five stages, 10 stages, or 50 stages. Each stage generally includes the impeller 50 and the diffuser 54 stacked or positioned serially.

As discussed above, the impeller 50 may be rotated relative to the case 24 of the pump assembly 20 to move a fluid within the pump 20. The diffuser 54 is generally held fixed relative to the case 24 of the pump 20. The impeller, or plurality of impellers 50 may include various portions, such as a hub and blade that are fixed or integrated together, as discussed herein.

In various embodiments, as discussed herein, the impeller 50 includes one or more blades. The blades may be molded in a mold that is a two-plate injection mold without inserts or slides that are inserted and/or moveable relative to a core or cavity of a mold. Thus, the mold may be referred to as a "simple" mold that includes only the two plates that come together to form a mold. A simple mold, as discussed herein, includes no slides or inserts to assist in forming a complex shape of a molded component.

The simple mold to form the blades or blade component, as discussed herein, may be achieved in various embodiments. For example, at least a portion of a hub is formed separate from the blades and a flange is formed perpendicular to the blade that will add strength to an individual blade, also referred to as a vane, and provide support for an energy director for subsequent welding to an independent hub piece. At least a portion of a hub is formed separate from blades and a flange is formed perpendicular to the blade and a rib underneath the flange which will provide support for an energy director for subsequent welding. At least a portion of a hub is formed separate from blades and a flange is formed perpendicular to the blade that will provide support for an energy director and one or more pins for subsequent welding.

In various embodiments, blades are formed in a group and in a staggered fashion, joined by one or more sacrificial beams with integrated blocks for interlocking and energy directors for subsequent welding. In one example, blades are formed and then grouped in a staggered fashion, joined by a "C" shape ring with integrated steps for interlocking and energy directors for subsequent welding. In one example, blades are formed in a staggered fashion, joined by a "C" shape ring with integrated steps for interlocking and energy directors for subsequent welding. In one example, blades are formed in a staggered fashion, joined by an "○" shape ring for a stacking assembly and energy directors for subsequent welding.

Additionally, or alternatively, as discussed herein, various portions may be added or altered in various configurations. For example, a flange may be added perpendicular to the blade that will add strength to the individual vane or blade and provide pin support for subsequent heat staking to an independent hub piece. A flange may be added perpendicular to the blade that will provide the clip support for subsequent fitting between the hub and cap pieces that were sonic welded beforehand. A flange may be added perpendicular to the blade that will provide the pin support for subsequent heat staking to an independent cap piece. The blades get trapped between the hub and cap pieces that will be welded subsequently with an energy director and heat stake pins. A flange may be added perpendicular to the blade that will provide the snap support for subsequent fitting between the hub and cap pieces that were sonic welded beforehand with energy directors. The blades slide in the dovetail groove created between the hub and cap pieces until the snap fits.

Figure 3A:
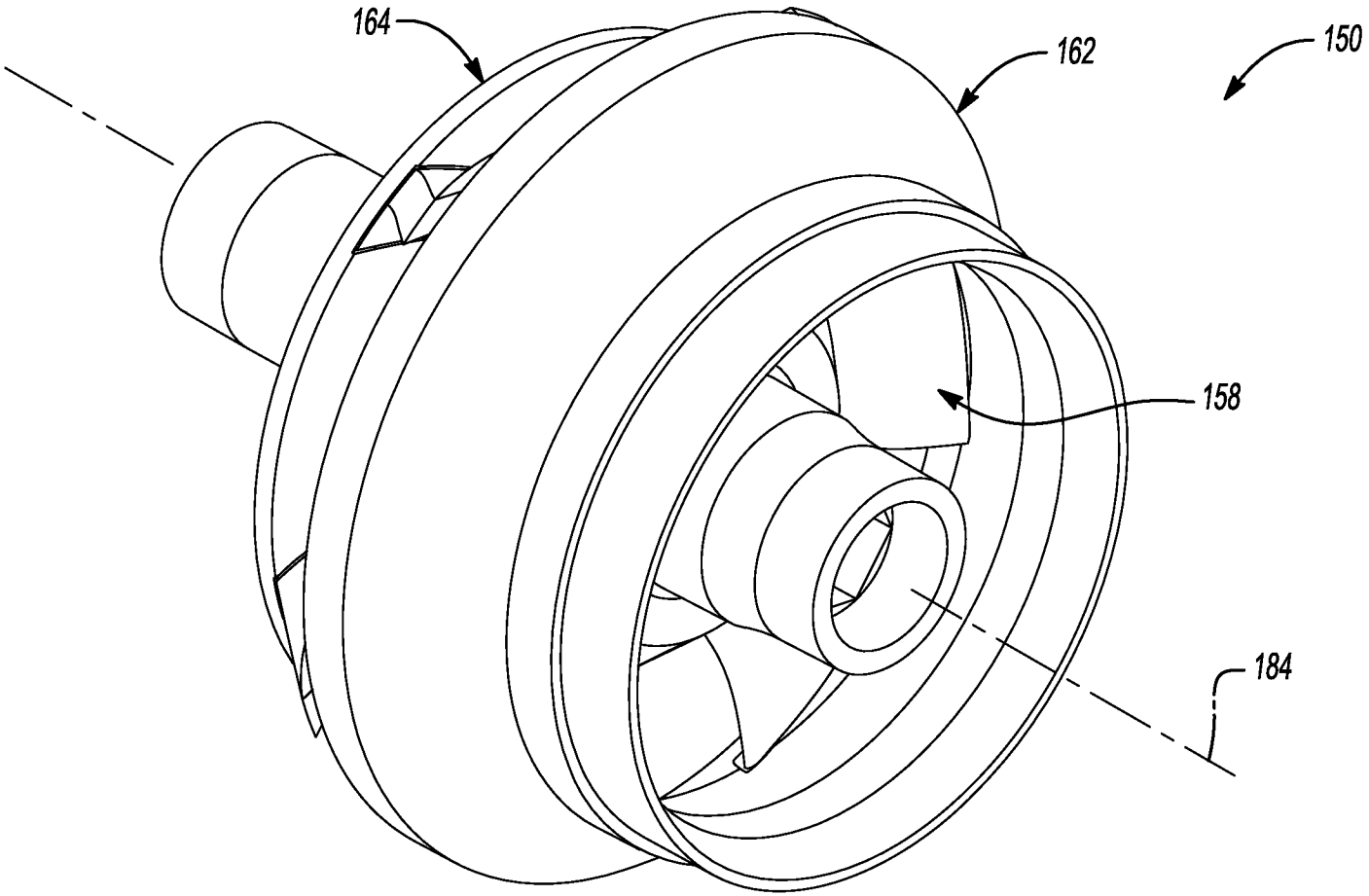
FIG. 3A is an assembled view of an impeller assembly, according to various embodiments.
Figure 3B:
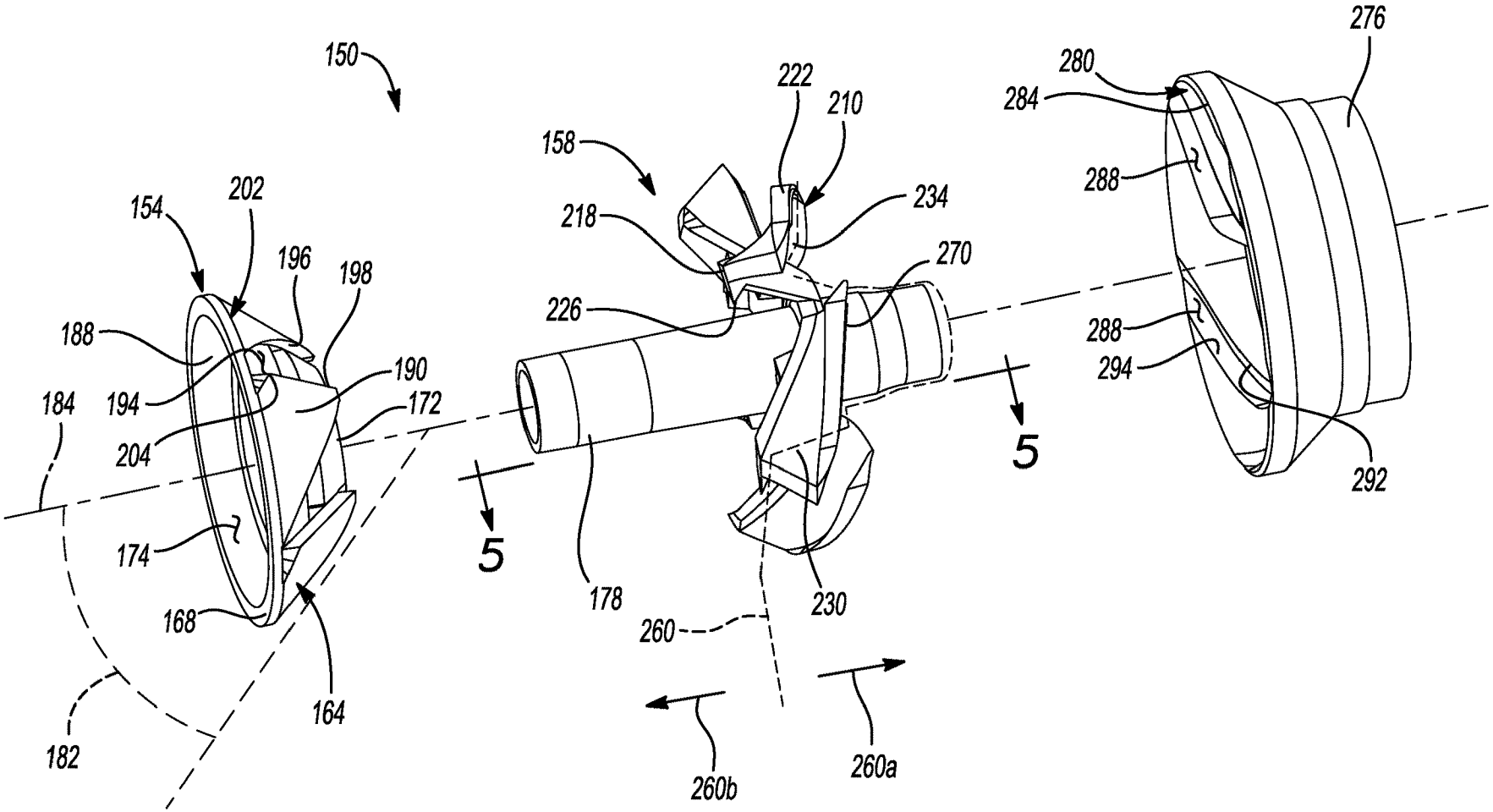
FIG. 3B and FIG. 4 are an exploded view of the impeller of FIG. 3A.
Figure 4:
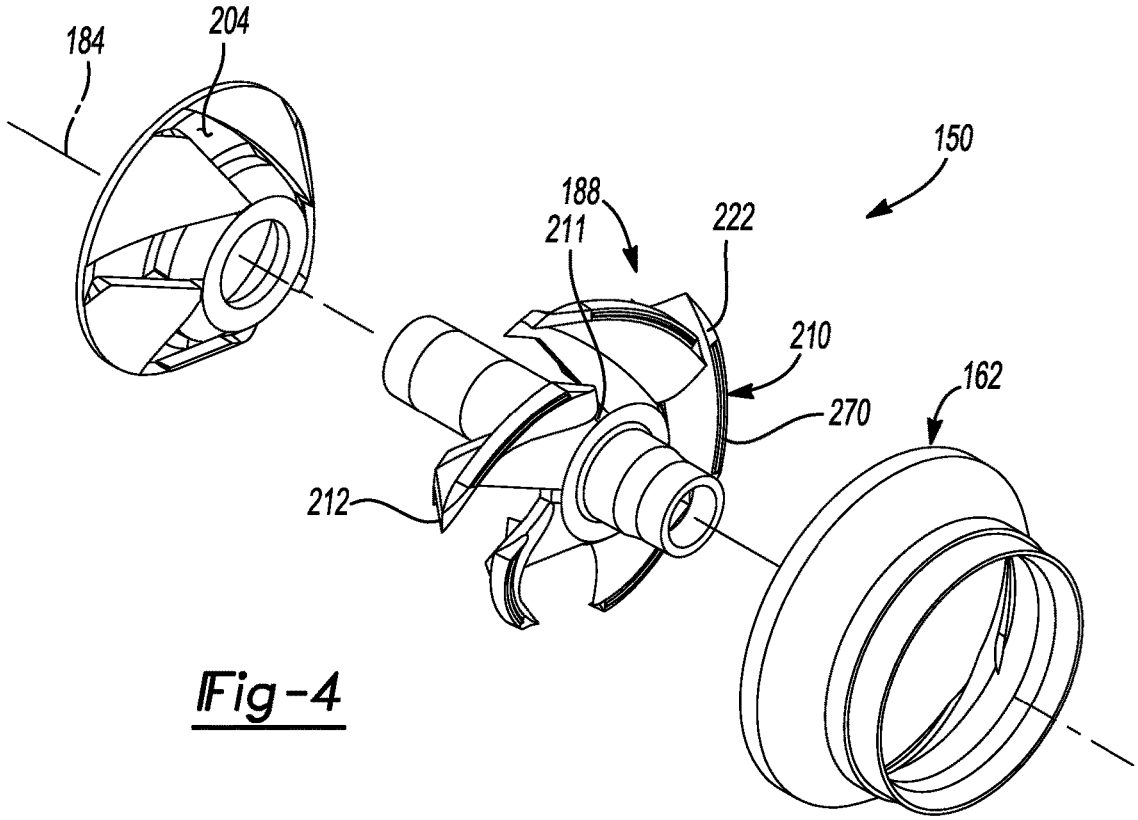

With reference to FIG. 3 and FIG. 4, according to various embodiments, the impeller 50 may include an impeller 150. The impeller 150 may be formed of various components that may be connected together, as discussed further herein. In various embodiments, the impeller 150 may include a hub or outlet shroud component 154, a blade or vane component 158, and a shroud or inlet shroud component 162. Each of the components may be formed separately and individually and assembled in a selected manner, as discussed further herein. Each component may be formed of selected materials. The material selected for the various components may be the same material and/or different materials. In various embodiments, the materials for the various components may include polymer materials, such as plastics including thermoplastics or thermosetting plastics. In various embodiments, reinforced plastics may also be used such as glass or carbon fiber reinforced plastics.

The various components may be molded individually in a two piece or two plate mold. In a two plate mold, generally only a first plate and a second plate of the mold may come together and a selected material, such as a selected melted polymer and/or monomer, may be injected into a mold cavity formed by the plates. The melted polymer may solidify and/or the monomer may polymerize to then form the component within the mold. The mold may then be opened at a selected separation seam to allow release of the molded component. No additional slides or inserts may be necessary to mold the various components including the hub 154, the blade component 158, and the shroud component 162.

In various embodiments, the hub 154 includes an external surface 164 that is generally frustoconical in shape. The surface, therefore, extends at an angle 182 relative to an axis 184 from a first end 168 to a second end 172. Further a bore or through bore 174 is formed through the hub 154. An elongated or engaging member 178 of the blade component 158 may extend through the bore 174. The longitudinal axis 184 may extend along the elongated member 178 of the blade component 158. The hub 154 further includes an internal surface 188 that may be substantially smooth or interact with a subsequent or adjacent stage of the pump assembly 20, such as a diffuser thereof.

The external surface 164 may include an upper or outer portion 190 and one or more troughs or grooves 194 that are depressed relative to the outer portion 190. The grooves 194 may include a first wall 196 and a second wall 198 and an outer or edge wall 202. At the edge wall 202 may be an offset portion 204 that may extend a distance away from or into the raised surface 190 from the wall 198. The depression 194 may receive a portion of a blade or vane member 210 of the blade component 158.

Figure 5:
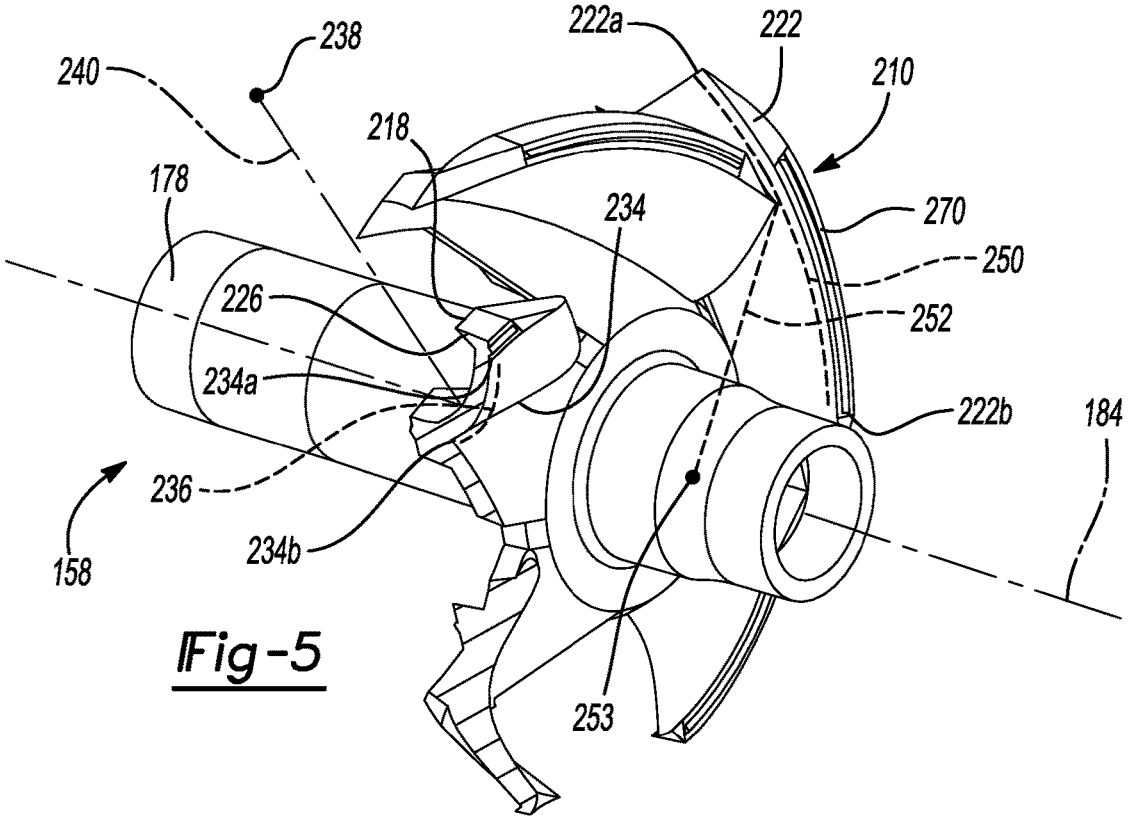
FIG. 5 is a partial cross-sectional view of a blade component of the impeller of FIG. 3A.

With continuing reference to FIGS. 3-5, the blade component 158 includes one or a plurality of blade members 210. Each of the blade members 210 extends from an outer surface 212 of the elongated member 178. Accordingly, the blade 210 may have a shaft end 211 and an outer end 212. Moreover, the blade 210 may have a hub contacting or engaging flange or surface 218 and a shroud end or engaging surface 222. The flange 218 may generally extend at an angle, such as perpendicular, to a face 234 of the blade 210. The flange 218, therefore, may provide rigidity and support to the blade 210.

As discussed above, the hub 154 includes the depression 194. The hub engaging surface 218 may also engage or may be engaged within the depression 194. The blade 210 may include a complementary shape to the depression 194 such that the walls 196, 198, 202 contact outer surface of the hub engaging surface 218. Further, the point or extending portion 204 may engage or receive a projection or extending region 226. In various embodiments, the projection region 226 may extend along a length of the blade 210. Accordingly, the point 204 may also extend the length of the wall 198 to substantially contact the blade 210 along the entire length of the depression 194.

In various embodiments, as discussed above, the hub 154 may be formed separately of the blade component 158. Upon assembly the blade component 158 may be inserted, such as by passing the elongated member 178 through the bore 174 along the axis 184, and then slightly rotated to allow the hub engaging surface 218 to engage into the depression 194, including the projection portion 226 to engage into the point 204. Also, the wall 198 may form and overhang or projection over the lower portion of the groove 194. Thus, the overhang may physically engage and assist in holding the blade component 158 relative to the hub component 154. The physical engagements, according to various embodiments, may be similar to a tongue in groove or a dovetail engagements. The physical engagement may be in addition to and/or alternatively to other connection mechanisms. Further additional connection mechanisms may be made such as adhesives, welding, sonic welding, and the like to connect the hub 154 to the blade component 158.

The blade 210, may be formed to include a selected geometry. Generally the blade 210 includes a downward directed to hub directed face 230. The blade 210 further includes an upward or shroud directed surface or face 234. The flange 218 may generally extend along the length of the blade and at an angle relative to the faces 230, 234. The blade 210 may generally had a selected curve, including a curve of one or more of the faces 230, 234.

Generally, the blade 210 includes a selected shape that, in various embodiments, may be a curve, including a double curvature. The curve may be any appropriate curve, as discussed herein, and may arc or be defined by an arc. The blade 210, therefore, may define a curve 236 (that may be referred to as a face curve). The curve 236 may include a constant or a variable (e.g. non-constant) radius 240 about a center 238. In various embodiments, therefore, the curve 236 may be defined by a spline. In various embodiments, the radius 240 may be the same or vary from the center 238 over the extent of the curve 236 (e.g. from a top 234*a* to a bottom 234*b* of the face 234). The specific radius 240 may be selected based on various features, such as efficiency of the pump assembly 20, size of the pump assembly 20, etc. For example, the radius may be about one millimeter (mm) to about 50 centimeters (cm). The curve 236 generally curves away from or is perpendicular to the long axis 184 of the blade component 158. The curve 236, however, may generally be formed in a plane with or parallel with the long axis 184.

Further, the blade 210, has a shroud facing surface or rib or ridge 222, and herein in various embodiments may be referred to as either. The ridge 222 may further include a curve 250 (that may be referred to as a ridge or rib curve)

that may have a center at the long axis 184, or other appropriate position. The curve 250 may generally be around the long axis 184 of the blade assembly 158. The curve 250 may generally extend radially from the long axis 184 and around the axis 184. The curve 250 may generally be formed in a plane perpendicular to the long axis 184. In various embodiments, the curve 250 may also be formed to have a radius 252 that may be the same or vary from a center 253 over the extent of the curve 250 (e.g. from a first end 222*a* to a second end 222*b* of the ridge 222). Any specific radius 252 may be selected based on various features, such as efficiency of the pump assembly 20, size of the pump assembly 20, etc. As discussed herein, various blade components may have blades with a double curvature similar to that discussed above thus including both of the curve 236 and the curve 250.

Thus, the blade 210 may include at least two curves that are substantially not in the same plane. Generally the curve 236 is in a first plane, which may be generally parallel with the long axis 184. The second curve 250 may be in a second plane that is generally perpendicular to the long axis 184. Accordingly, each of the blades 210 may include at least two curves in two planes. In various embodiments, the two planes of the two curves 236, 250 intersect. It is understood, that various curves, as discussed herein, may be defined by various blade members.

Although each of the blades 210 may include two curves, the blade configuration of the blade component 158 may be formed in a single two piece or two plate mold. Generally, the blade component 158, as illustrated in FIG. 3B, may be formed in a single mold, that may be a simple mold, where a first mold plate and a second mold plate may meet at a mold plate mating or contact line or series of lines, exemplarily illustrated as line 260. The two plates of the mold may contact at the contact or parting line 260 and, therefore, may also be separated from the line 260, while allowing for the blade component 158 to be formed with no additional slides or inserts. Thus, the blade component 158 may be formed in a two plate mold. This also allows, as discussed herein, that the plates may move apart in the directions of the arrows 260*a*, 260*b* and that each portion of the blade members of the blade component 158 are unobstructed in the direction of the arrows 260*a*, 260*b* by another portion of the blade component 158.

The blades 210 may further include an energy director or projection 270 that extends from the ridge 222. The energy director 270 may allow or enhance sonic welding of the blade component 158, including each of the blades 210, to the shroud 162. In various embodiments, the energy director is sacrificial material for sonic welding. Thus, each blade portion or member may be joined and sealed or at least partially sealed to the shroud 162. Joining to the shroud 162 may assist in hydraulic efficiency and power of the pump 20.

The shroud 162 may further include an external surface 276 and an internal surface 280. The internal surface may include an outer edge or surface 284 and a depression 288. The depression 288 may include a selected geometry, such as a first wall 292 and a second wall 294. The ridge 222 of the blades 210 may be engaged and nested into respective ones of the depressions 288 of the shroud 162. In a selected time, the shroud 162 may then be sonically welded, or otherwise connected, to the blade component 158 with use of the energy directors 270.

Accordingly, the impeller 150 may be formed of the three components including the hub 154, the blade component 158, and the shroud component 162 and then be fitted or fixed into one single component of the impeller 150 with various techniques. As discussed above various adhesives, sonic welding, welding, or the like may be used to fix the hub 154, the blade 158, and the shroud 162 together as a single unit. The single unit impeller 150, therefore, may include the selected geometry of the blade 210 while being formed as a single component in an injection molding system and fitted into a single impeller.

As discussed above, the impeller 50, for example including the impeller 150, may include the blade component 158. The blade component may include a plurality of blade members as discussed above and further herein. In various embodiments, with reference to FIG. 6, a blade component 358 is illustrated. The blade component 358 may include a plurality of blade members connected to a central blade component portion 362 that may define a central opening or bore 364. The blade component 358 may include a plurality of blade members, such as a first blade member 366 and a second blade member 370. The two blade members 366, 370 may be formed to include the two curves, as discussed above. A first curve 372 may include a long edge or curve along a ridge 374 of the first blade member 366 and a second ridge 378 of the second blade member 370. Further, the first blade member 366 may include an outlet edge 380 and an inlet edge 384 and terminate at a terminal end 386. Similarly, the second blade member 370 may include an outlet edge 388 and an inlet edge 392.

Figure 6:
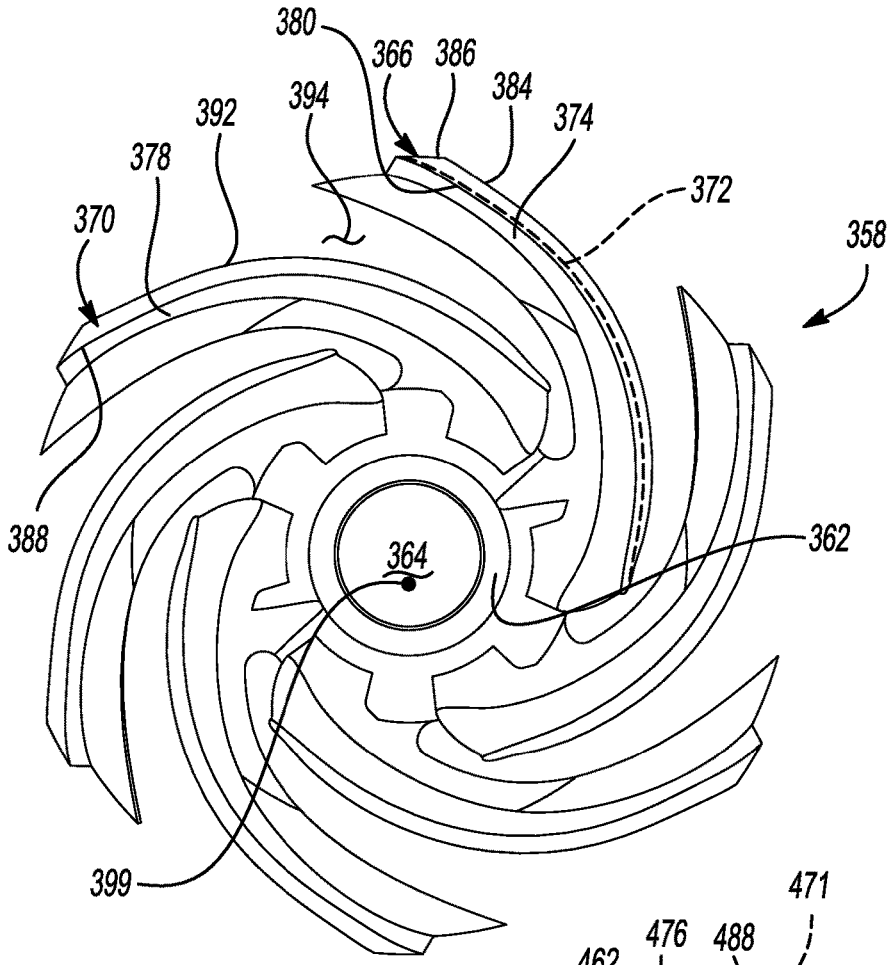
FIG. 6 is a blade component with no overlap, according to various embodiments.

As illustrated in FIG. 6, the outlet edge 380 of the first blade member 366 does not overlap the inlet edge 392 of the second blade member 370 when viewed along a long axis 399 through the blade component 358. In various embodiments, a space 394 may be defined between the outlet edge 380 and the inlet edge 392. The space 394 may be defined between each of the blade members of the blade component 358. Accordingly, in various embodiments, the blade portions of the blade component may be separated such that the blade portions of the blade component do not overlap one another along an axis through the blade component 358, such as through the bore 364. As discussed herein a non-overlapping blade component may be formed in various manners.

Figure 7:
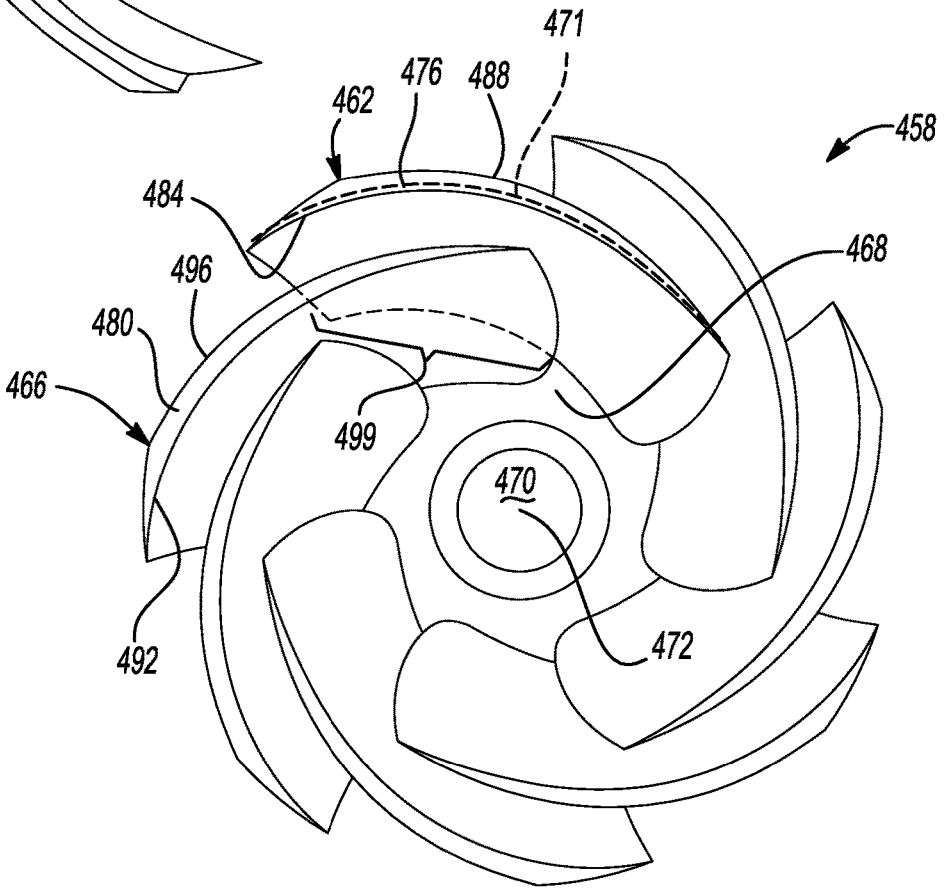
FIG. 7 is a blade component having blade overlap, according to various embodiments.

With reference to FIG. 7, a blade component 458 is illustrated. The blade component 458 may include a plurality of blade portions or members, such as a first blade member 462 and a second blade member 466. The blade members may extend and be connected to a central blade component portion 468 that may define a central bore 470. An axis 472 may extend through the bore 470.

Again, each of the blade members, such as the first blade member 462 and the second blade member 466 may have the two curves, as discussed above, including a curve radially 471 from the central axis 472 along a surface or ridge 476 of the first blade member 462 and a second ridge 480 of the second blade member 466. Further, each of the blade members may include respective outlet and inlet edges, such as the first blade member 462 including an outlet edge 484 and an inlet edge 488. Similarly, the second blade member 466 may include an outlet edge 492 and an inlet edge 496.

The blade members 462, 466 as illustrated in FIG. 7 may overlap one another such that the outlet edge 484 of the first blade member 462 is at least partially covered or obscured by the inlet edge 496 of the second blade member 466 when viewed along the long axis 472 of the blade component 458. Each of the blade members of the blade component 458 may overlap the adjacent blade members at overlap 499. Accordingly, the blade component 458 may be a substantially overlap or at least partially overlapping blade component.

The overlapping blade assembly or arrangement may be formed in various manners, as discussed further herein in various embodiments.

Accordingly, blade components, according to various embodiments, may include a substantially non-overlapped configuration such as the blade component 358 or an overlap configuration such as the blade component 458. It is understood that selected configurations of the blade components may be formed according to various embodiments. Various embodiments of the impeller, therefore, as discussed further herein and above, may include arrangements of the blade component including non-overlapped or overlapped blade configurations.

Figure 8A:
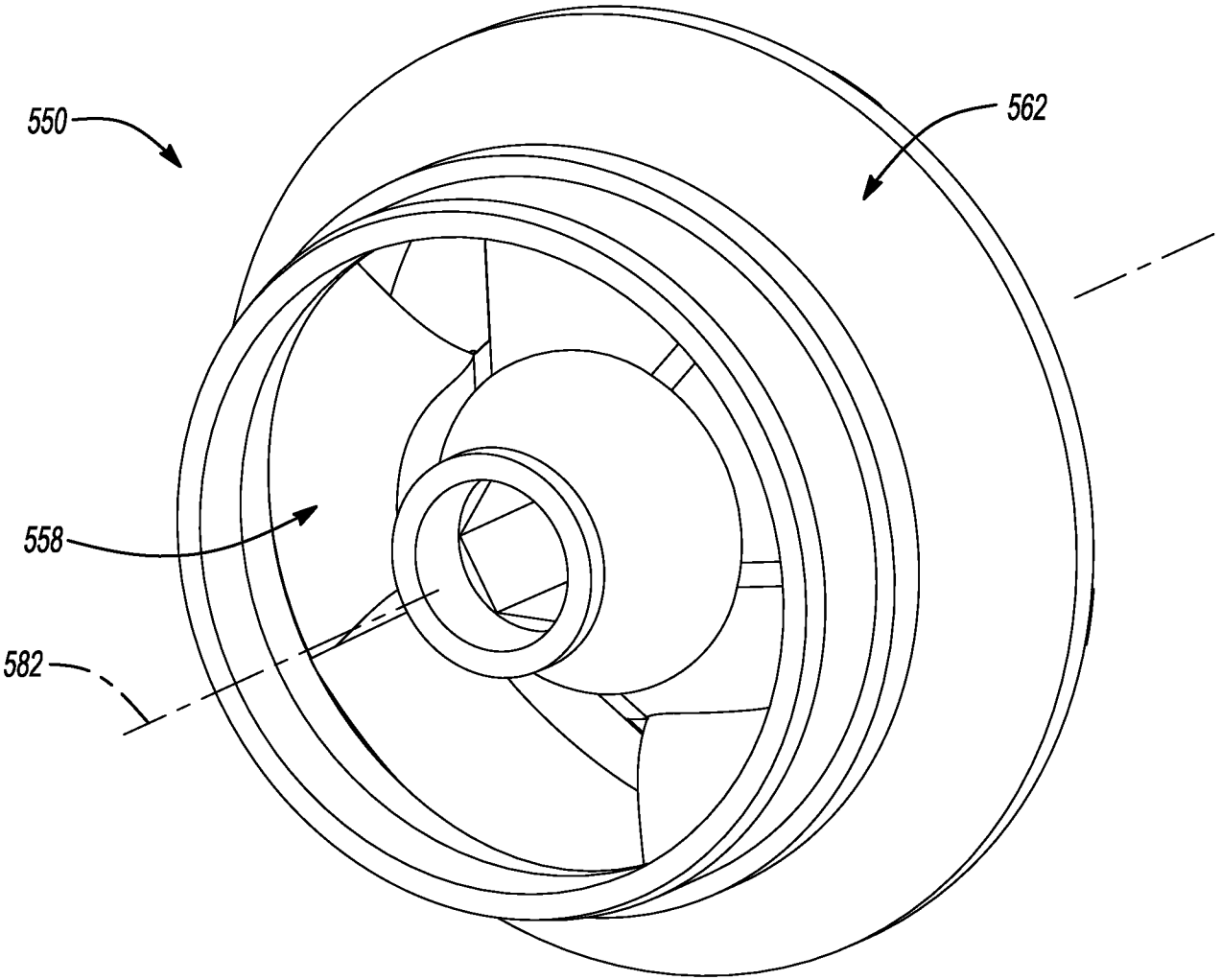
FIG. 8A is an assembled view of an impeller, according to various embodiments.
Figure 8B:
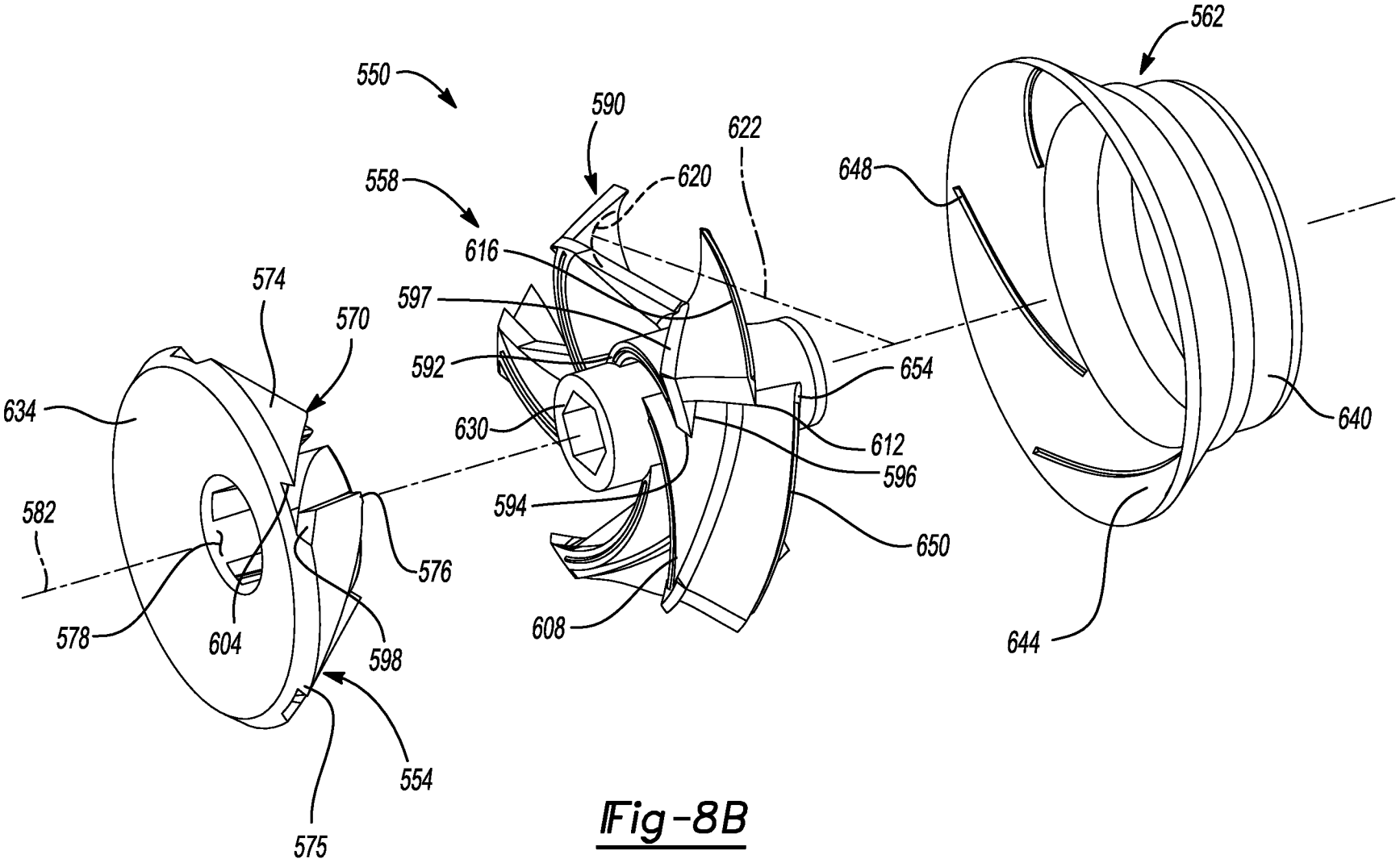
FIG. 8B and FIG. 9 are exploded view of the impeller assembly of FIG. 8A.

Turning reference to FIGS. 8A and 8B, an impeller 550 is illustrated. The impeller 550 may include portions that are similar to the impeller 150, discussed above. According to various embodiments, the impeller 550 may include a hub component 554, a blade component 558, and a shroud component 562. The various components, including the hub component 554, the blade component 558, and the shroud component 562 may be similar to the respective hub component 154, blade component 158, and shroud component 162 of the impeller assembly 150 discussed above. The similar details thereof will not be repeated here, but are understood to be included in various embodiments.

With further reference to FIG. 8B, the impeller assembly 550, including the hub component 554, may include a groove or depression 570 that extends below an outer surface 574 of the hub component 554. The hub component may be generally frustoconical in shape from a base 575 to a top 576. Thus, the outer surface 574 may extend at an angle relative to a central or long axis.

The groove 570 may include a plurality of grooves extending around the hub component 554. The hub component 554 may include or define a central bore 578 that may rotate around an axis 582 similar to the axis 184 as discussed above. A plurality of the grooves 570 may be formed around the component 554, similar to the depression 194 discussed above. The depression 570 may be formed to extend a selected depth into the hub component 554, such as below the surface 574 to receive a portion of the blade component 558, including a respective one of the blade members 590. The blade members 590 may include a hub engaging region that may also be referred to as a rib or flange 592 that includes a projection or point 594 and a leading or front hub engaging edge 596 and a rear engaging surface or edge 597. The flange 592 may be received in the depression or groove 570 to assist in engaging or holding the blade component 558 relative to the hub assembly 554. Further, the hub assembly 554 may include a receiving point or portion 598 and a selected undercut or receiving edge 604 in the groove or depression 570. Accordingly, the blade component 558 may be received into the depression 570 and held relative thereto. The blade component 558 may be engaged in the depression 570 due to the undercut 604 engaging and/or receiving the rear engaging surface or edge 597. Further, the blades may include an energy riser or projection or ridge 608 that may allow for a sonic welding of the blade members 590 to the hub portion 554. The fixation, such as with sonic welding, may further seal the blade component to the hub component 554, according to various embodiments. The sealing may again assist in the hydraulic efficiency and power of the pump 20.

Figure 9:
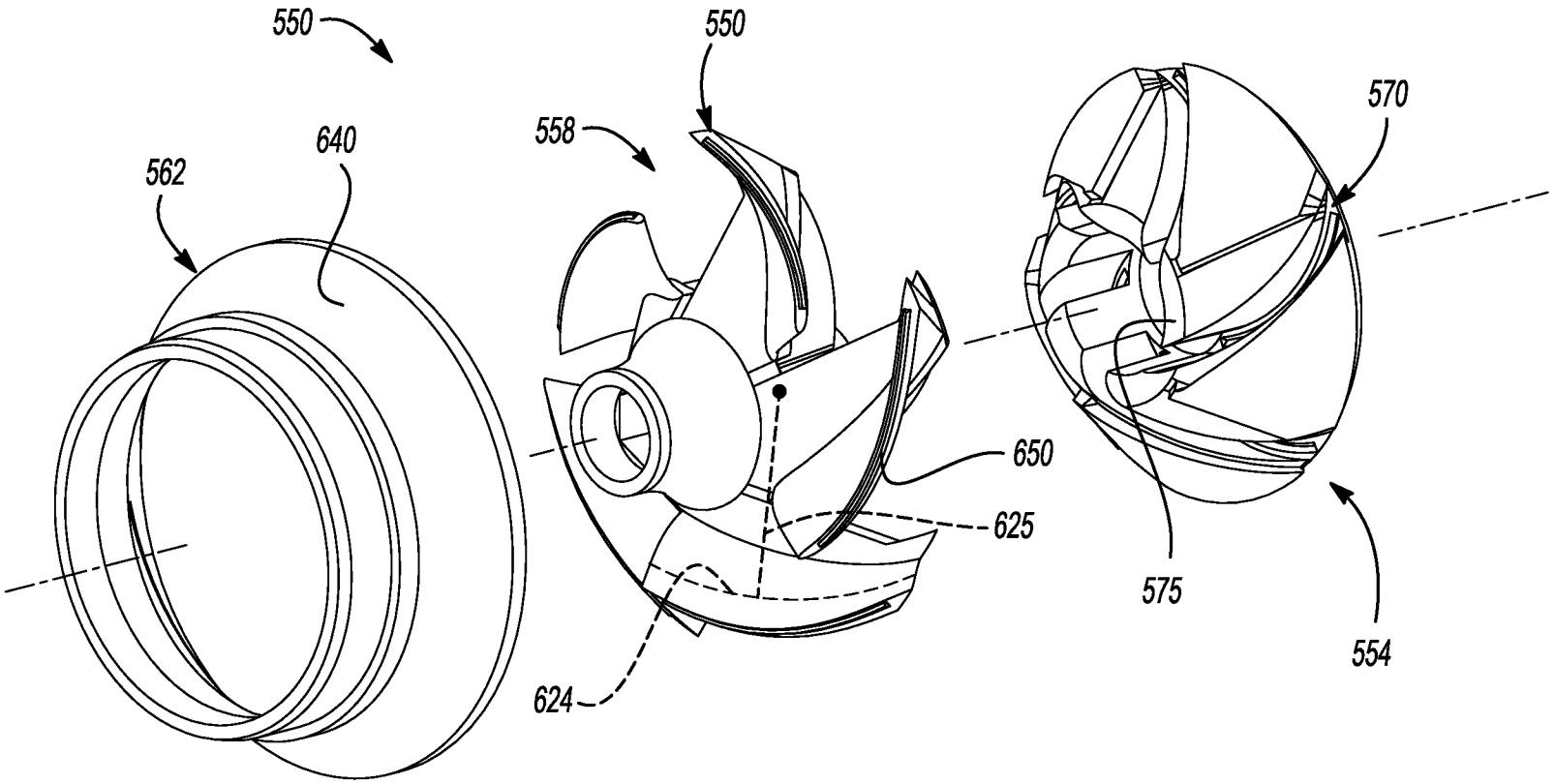

With further reference to FIG. 9, the blade component 558 may further include a plurality of the blade members or portions 590 each having respective outlet edges 612 and inlet or tip edges 616. As discussed above, each blade member 590 may include a double curvature, including a first curve 620 and a second curve 624. The curve 620 is defined by a radius 622 that extends generally perpendicular to a long axis 582. As discussed above, the radius 622 may vary over the extent of the curve 620. The second curve 624 may be generally extend radially from and around the axis 582 and has a radius 625 that may also vary over the extent of the curve 624. Accordingly, each of the blade members 590 may include at least the two curves 620, 624 that may have varying radius over their respective extends. As discussed above, the radii may vary based on selected efficiency, speed of rotation, etc.

In various embodiments the blade component 558, with reference to FIG. 9, may include a generally non-overlapping blade configuration. Nevertheless, the blade component 558 may be formed in a two plate mold wherein a single core and a single cavity may be used to form the blade component 558.

In various embodiments, he blade component 558 may include a shaft or extension portion 630 that does not extend substantially beyond a bottom surface or edge 634 of the hub component 554 when assembled. It is understood, however, that the extension 630 may extend any selected distance. Nevertheless, the impeller assembly 550 may engage a shaft to be rotated in a pump assembly, such as the pump 20. Further the dual curved or dual radius blade components, including the blade member 590 may be engaged and held relative to the hub component 554 to assist in longevity and durability of the impeller 550.

Further the shroud component 562 may include an outer surface 640 and an inner surface 644. The inner surface 644 may include recesses or groves 648 to receive energy rises or projections 650 may extend from a rib or ridge 654 of the blade members 590. The groove 648 may receive the energy riser 650 to allow for sonic welding or selected welding of the blade component 558 to the shroud components 562. It is understood, however, that the blade component 558 may be fixed to the shroud component 562 in any selected manner, including those discussed above such as using selected adhesives and/or selected welding or fixation techniques. Similarly the blade component 558 may be fixed to the hub component 554 in a selected manner including sonic welding, heat welding, and the like including adhesives as discussed above.

Figure 10:
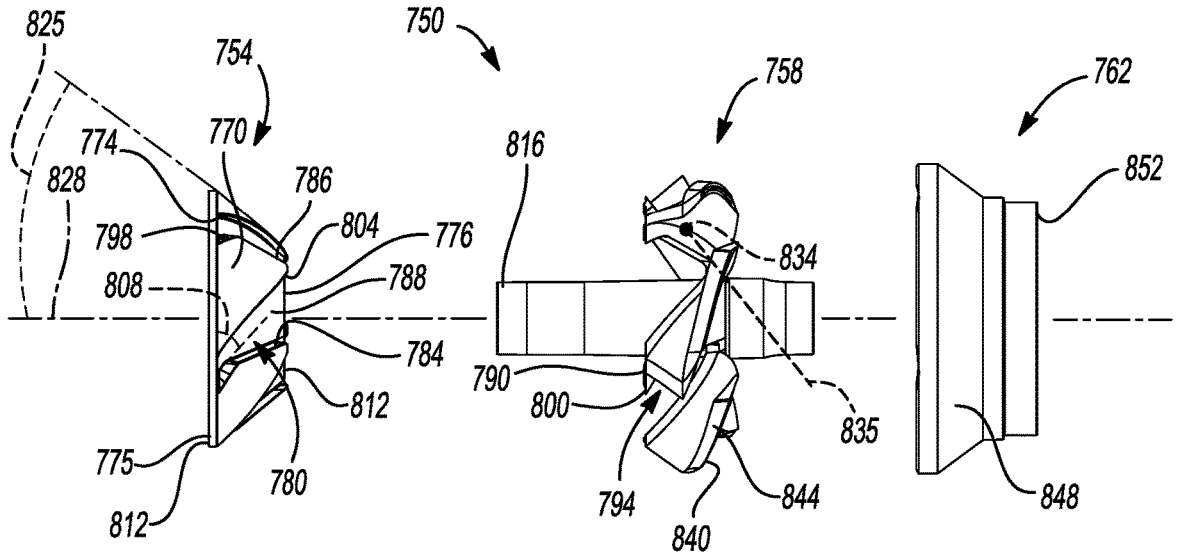
FIG. 10 and FIG. 11 are an exploded view of an impeller assembly, according to various embodiments.
Figure 11:
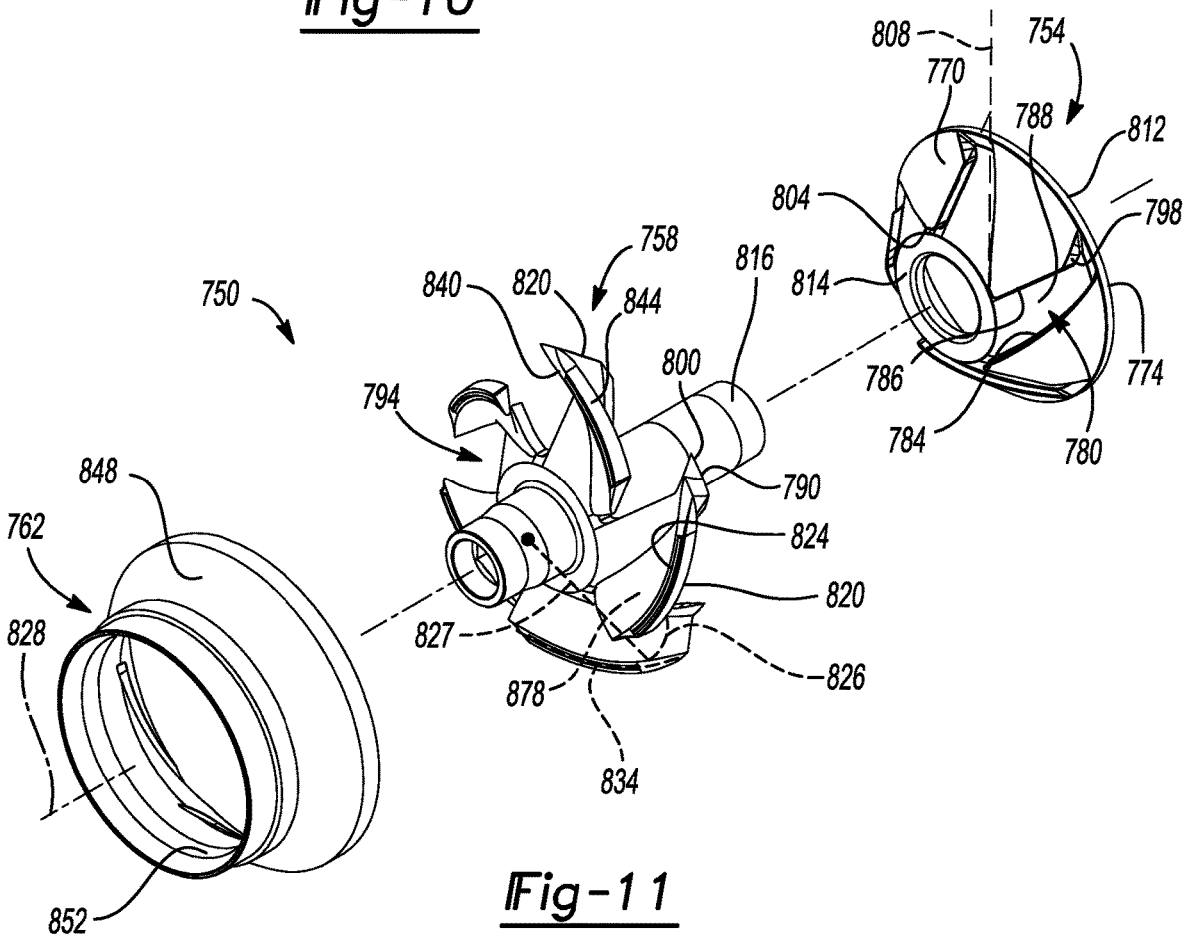

Turning reference to FIG. 10 and FIG. 11, an impeller 750 is illustrated. The impeller 750 may include components similar to the impeller 150, as discussed above. The impeller 750 may include components similar to those above and will be discussed generally relative to the impeller 150, with differences noted therein. The impeller 750 may include a hub assembly 754, a blade component 758, and a shroud component 762.

The hub component 754 includes an outer or upper surface 770 and an inner surface 774. The hub component may be generally frustoconical from a base or bottom 775 to a top portion 776. Thus, the surface 770 may extend at an angle 825 relative to the axis 828.

Formed into the upper surface 770 is one or more grooves or depressions 780. The grooves or depressions include a first wall 784 that includes an undercut or overhang 786 relative to a bottom or inner surface 788. The overhand 786 may engage a hub engaging portion or flange 790 of one or more of the blade portions 794 of the blade assembly 758. The depression or groove 780 may further include a point or engaging region 798 that can receive or engage a point or projection 800 of the blade member 794.

The groove 780 may further include a rear wall 804. The front wall or first wall 784 may generally define an angle 808 relative to the rear wall or second wall 804. The angle 808 may cause the distance between the first wall 784 and the second wall 804 to increase from a bottom or distal end 812 of the hub portion 754 to a top or proximal end 814 of the hub component 754. The groove 780 receives the hub engaging portion 790 of the blade member 794.

As discussed above, the blade component 758 may be fixed to the hub component 754 in a selected manner such as with sonic welding, heat welding, selected adhesives, or the like. Generally the blade portion 794 includes the hub engaging portion 790 that is engaged into the groove 780. The blade component 758 may then be fixed to the hub component 754 at or with the flange 790. A shaft or extension portion 816 of the blade component 758 may pass through a central bore of the hub component 754 and then the blade portion 794 may be fixed to the hub component 754.

The blade component 758 includes one or a plurality of the blade members 794. The blade member 794 may be fixed to the shaft 816 of the blade component 758. The blade member 794 may generally include an inlet edge 820 and outlet edge or surface 824. The blade component 794 may generally include a double curve or two curves, as discussed above, including a first curve 826 that is generally defined by a radius 827 that may extend from longitudinal axis 828 and the curve may be in the same plane or near the same plane as the longitudinal axis 828. As discussed above, the curve 826 may have a constant or varying radius over the extent of the curve, thus the radius 827 may have more than one length when defining the curve 826. The blade component 794 may further include a second curve 834 that is generally around the central or longitudinal axis 828 and may be in a plane generally perpendicular to the plane of the longitudinal axis 828. The curve 834 may also be define by a radius 835. As discussed above, the curve 834 may have a constant or varying radius over the extent of the curve, thus the radius 835 may have more than one length when defining the curve 834. Thus, the blade member 794 may include the two curves or a double curvature relative to two planes, as discussed above.

Generally, the blade component 758 may be formed by a two plate mold, as discussed above. The double curvature, including the first curve 826 and the second curve 834, of each blade portion 794 may be formed with a single cavity mold. The blade component 758 may be formed separately from the hub component 754 and fixed thereto, as discussed above. Further the blade component 758 may be fixed to the shroud component 762.

The blade component 758 may be fixed to the shroud component 762 such as with selective adhesive, welding (e.g. sonic or heat welding), or other appropriate fixation mechanisms. The blade portions may each include an energy riser or director 840 that extends from a rib 844 at an edge of the blade component 794. The shroud 762 includes an outer or upper surface 848 and an inner or blade contacting surface 852. The inner surface 852 may include a plurality of depressions or grooves to receive the energy directors 840 of the blade component 794. The blade component 758 may then be fixed to the shroud component 762 such as with sonic welding or other appropriate fixation techniques. Accordingly, the impeller 750 may be fixed together from the selected components, including the hub component 754, the blade component 758, and the shroud component 762. The selected geometry of the blade component 758 may then be achieved while forming a unitary final impeller 750.

With reference to FIG. 12, FIG. 13, FIG. 14, and FIG. 15, an impeller 950 is illustrated. The impeller 950 includes components similar to those discussed above of the impeller 150. Accordingly, herein differences regarding the impeller 950 will be emphasized and similar components will be referenced, but is understood may include features similar to those discussed above.

The impeller 950, therefore, may include a hub component 954, a blade component 958, and a shroud component 962, as illustrated in FIG. 12, the impeller 950 may be assembled as discussed above and further herein, into an integral unit. The impeller 950 may be assembled into the pump 20, accordingly to various embodiments, as discussed above. As illustrated in FIG. 13, the various components may be formed separately, as also discussed above, including a separate formation of the hub component 954, the shroud component 962, and the blade component 958. With reference to FIG. 14 and FIG. 15, however, the blade component 958 may be formed of selected subcomponents such as a first blade subcomponent 970 and a second blade subcomponent 974.

The blade subcomponents 970, 974 may include the same number of blades and may be identical relative to one another. The two blade components 970, 974 may be formed separately, but may each include three blade portions such as a first blade portion 976, a second blade portion 978 and a third blade portion 980 of the first blade component 970 and a first blade member 984, a second blade member 986 and a third blade member 988 of the second blade subcomponents 974.

The blade subcomponents 970, 974 may be substantially identical, but rotated relative to one another to allow them to be assembled into the single blade component 958, as illustrated in FIG. 13. In various embodiments, therefore, a plurality of blade subcomponents may be formed into a unified or integral blade component, such as the blade component 958. The unified blade component may be integrated into a selected component, such as the impeller 950. The blade subcomponents 970, 974, therefore, will be discussed in relation to the first blade subcomponent 970. It is understood that the second blade subcomponent 974 may include similar or identical portions to allow for formation of the blade subcomponent 958.

In particular, each of the blade members 976, 978, 980 may include respective central or engaging members 992, 994, 996. Each of the engaging portions 992, 994, 996 may extend a selected distance of a circle or "C" and include a selected curve or arc length, such as a first arc length 1000 of the first engaging portion 992. Each of the engaging portions 992, 994, 996 may include an arc length that is one-sixth of a circle circumference. The second blade component 974 may similarly include respective engaging portions 1004, 1006, 1008 that are also substantially one-sixth of a circle circumference.

Orienting the first blade subcomponent 970 relative to the second blade subcomponent 974 such that the respective engagement members are positioned in a space between engagement portions of the second member allows for formation of a blade ring or "○" 1010, as illustrated in FIG. 13. The central ring may engage a ring engaging portion 1014 of the hub component 954 to assist in holding the blade component 958 in a selected orientation in the impeller 950.

Similarly, when assembled into the single blade component 958, each of the blade portions, such as the first blade portion 978 includes a hub engaging edge or flange 1018 to engage a groove 1022 in the hub component 954. The flange 1018 may further extend at an angle relative to a face of the blade. The groove 1022 may include respective opposing walls 1024 and 1026. As discussed above, a selected one of the walls, such as the wall 1026 may include an overhang or an undercut to engage or hold the hub engaging portion 1018 of the blade component 958. Accordingly, as illustrated in FIG. 12, the hub component 954 may engage with a physical connection the hub engaging portion 1018 of the blade member 976 and the other respective blade members.

Further, as discussed above, the blade component 958 may include various portions, such as energy directors, to assist in welding or fixing the blade component 958 to the hub member 954. Similarly or in addition thereto other connection mechanisms may be used such as an adhesive, heat welding, or the like. Thus, the blade component 958 may be fixed to the hub component 954.

Further, each of the blade subcomponents 970, 974 may include beams or connectors, such as a first beam 1130 and a second beam 1132 that connect adjacent blade members, such as the first beam connector 1130 connecting the blade 976 and the blade 978, the second beam connector 1132 connecting the blade member 978 with the blade member 980. Due to the inclusion of three blade members of the first blade subcomponent 970 only two beam members 1130, 1132 are needed to connect all three blade portions. The second subcomponent 974 may be identical or substantially identical to the first subcomponent and therefore also includes two beam connectors, such as a first beam connector 1136 and a second beam connector 1138. Accordingly, the subcomponents 970, 974 may be formed as single units that maintain a connection and orientation of the respective blade members until final assembly into the impeller 950.

Further the beam connectors, such as the beam connectors 1130, 1132 may be positioned relative to the hub engagement members 992, 994, 996 such that the hub connectors or engagement members 1004, 1006, 1008 may be positioned over the beam connectors 1130, 1132 while allowing for the hub connectors 1004-1008 to be substantially flush with the hub connectors 992-996 of the first blade subcomponent 970. Accordingly the respective beam connectors, such as the beam connectors 1130, 1132 allow for the connection and orientation of the blade members at the respective blade subcomponents 970, 974 while allowing for connection and orientation in a substantially flush manner of the blade ring portion 1010.

The blade portions of the blade component 958 may all include a double curvature or at least two curves, as discussed above. For example, the blade member 984 may include a first curve 1040 along a surface of the blade 984, such as generally toward or facing a central axis 1044 of the impeller 950. The blade component member 984 may further include a second curve 1048 generally along a rib or top surface 1050 of the blade component 984. Each of the respective blades may include the substantially similar curves 1040, 1048, as discussed above. In various embodiments, the two curves may be defined with a constant respective radius or may be defined by selected varying radii, as discussed above.

As discussed above, the configuration of the blade members in the blade subcomponents 970, 974 may allow the blade components to be formed in a single mold including two plates such as a first including a core, and a second including a cavity. The configuration of the respective blade members, such as the blade members 976, 978, 980 may be made in a single mold while maintaining or forming the double curvature including the curves or arcs 1040, 1048 of each of the blade portions. Including the two blade subcomponents 970, 974 allows for the formation of a blade component 958 including at least six blade members having the double curvature while being formed in a two plate mold or injection molding system.

The shroud 976 may be fixed to the blade component 958 in a manner similar to that discussed above. In particular, the shroud component 962 may have an outer surface or ring 1060 and an inner or bottom surface 1064. The shroud 962 may include a plurality of grooves, such as a first groove 1068 formed into or extending past the surface 1064. The groove 1068 may engage an energy director or the upper rib 1050 of the blade portions of the blade component 958. Sonic welding or other connection mechanisms may internally connect to the blade component 958 with the shroud 962. Other connections may include adhesives, heat welding, or the like to connect to the blade component 958 to the shroud 962. Regardless of the connection technique, the impeller 950 may be formed of the three components including the hub 954, the blade component 958, and the shroud 962, even when the blade component 958 includes a plurality of sub portions or components such as the first and second subcomponent 970, 974.

With reference to FIG. 16, FIG. 17, and FIG. 18, an impeller 1150 is illustrated. The impeller 1150 may include portions similar to the impeller 950, discussed above, and similar portions will not be repeated in detail here. Generally, the impeller 1150 may include a hub component 1154, a blade component 1158 and a shroud component 1160. The blade component 1150, with reference to FIGS. 17 and 18, may include two subcomponents including a first blade subcomponent 1170 and a second blade subcomponent 1174. Each of the blade subcomponents 1170, 1174 may include a plurality of blade members, such as three blade members including a first blade member 1178. Each of the blade members may be connected to a connection portion 1184. The second blade subcomponent 1174 may also include a first blade member 1188 and each of the blade members of the second subcomponent 1174 may be connected to a central connection 1192.

The two blade subcomponents 1170, 1174 may be substantially similar save for the central connection or connection portion 1184, 1192. In the first blade subcomponent 1170, the central connection portion 1184 may include a first region 1196 and a second region 1198 that differ from one another by thickness and, therefore, define a step 1200 between the two regions 1196, 1198. The step 1200 may be formed on a side of the central connection 1184 similar to a side which the blade members, such as the first blade member 1178 extends.

In the second blade subcomponent 1174 the central connection 1192 may also include a first portion 1204 and a second portion 1208 that again differ in thickness and, therefore, form a step 1212 there between. In the second blade subcomponent 1174, the step 1212 may extend or be formed on a side of the central connection 1192 away from the side or direction of the blades extending from the central connection 1192. Accordingly, the blade subcomponents 1170, 1174 may be rotated relative to one another such that in an assembled configuration the single blade component 1158 forms a central or ring connection or configuration 1218 is defined by the blade component 1158, as illustrated in FIG. 16. Thus, the central ring connection 1218 may have a substantially flat upper and/or lower surface for assembly into the impeller 1150.

The ring portion 1218 may be engaged in a ring engagement region, such as a depression or groove 1220, formed or defined by the hub component 1154. In addition, or alternatively thereto, the hub component 1154 may form a plurality of grooves 1224 below an upper surface 1226 of the hub component 1154. Each groove of the plurality of grooves 1224 may receive a hub engaging surface or portion of each of the respective blade members, such as a hub engaging portion 1128 of the first blade 1178 or a hub engaging portion 1229 of the blade member 1188 of the second subcomponent 1174. As discussed above, various connection mechanisms may be used, such as sonic welding, adhesives, heat welding, or the like. The blade component 1158 may be fixed or connected to the hub component 1154 as a single portion by orienting the first subcomponent 1170 relative to the second subcomponent 1174 and then forming the assembly relative to the hub component 1154.

The separation or creation of the blade component 1158 as the two subcomponents 1170, 1174 allows for the creation of each of the blade members, such as the first blade member 1178 to include at least two curves or a double curvature, as discussed above. Accordingly, the blade member 1178 may include a first curve 1230 that may extend generally at an angle perpendicular to a central axis 1234 of the impeller 1150. The blade member 1178 may further define a second curve 1238 that is generally formed along an upper edge or rib 1240 of the blade member 1178. The second curve 1238 may generally be around or circumferential relative to the long axis 1234.

Further, the formation of the two separate components or subcomponents 1170, 1174 of the blade component 1158 may allow for the formation of a substantially overlapping adjacent blade, such as in the assembled configuration, as illustrated in FIG. 16 and similar to the overlapping blades illustrated in FIG. 7 above. Therefore, the blades may be formed to include the double curvature, such as the first curve 1230 and the second curve 1238 of each of the blade members, have substantial overlapping, as discussed above, and still be formed in a single two plate mold including a first plate with a core and a second plate with a cavity. The assembled impeller 1150, however, may include the blade component 1158 including the double curvature design and overlap while being formed of a simple mold configuration.

Further, the blade component 1158 may be fixed to the shroud 1160 in a manner similar to that discussed above. The shroud 1160 may include an external or upper surface 1250 and a lower surface 1254. The bottom surface 1254 may include one or more grooves to receive an upper edge, such as the rib 1240 and/or energy director thereof into the groove formed on the bottom surface 1254. As discussed above sonic welding, heat welding, or the like may be used to fix the blade component 1158 to the hub component 1154. Accordingly, fixation of the blade component 1158 to the shroud 1160 may be performed in a manner similar to that discussed above.

With continuing reference to FIG. 16 and additional reference to FIG. 19 and FIG. 20, the impeller 1150 may include the hub component 1154 and the shroud component 1160 with a blade component 1258. The blade component 1258 may include subcomponents, such as a first subcomponent 1270 and a second subcomponent 1274. The subcomponents 1270, 1274 may be similar to the subcomponents 1170, 1174, discussed above. The subcomponents, therefore, may each include a plurality of blades such as a first blade component 1280 and a second blade component 1284 in their respective blade subcomponents 1270, 1274. Each of the plurality of blades and the blade subcomponents may be connected to a central ring, such as a first ring 1288 and a second ring 1292. The respective rings 1288, 1292 may be substantially annular rings such as an "○" shaped ring, that are complete and a substantially single thickness throughout. Accordingly, the two subcomponents 1270, 1274 may be positioned atop of one another such that the blades alternate between the two subcomponents and a single blade subcomponent configuration similar to the blade subcomponent 1158 discussed above.

By the rings 1288, 1292 being formed of a substantially single thickness each, the resulting blade subcomponent 1258 may be substantially flat at the central ring formed by the combination. Further, the respective blades may be offset relative to the respective rings 1288, 1292 such that a top or shroud engaging surface of the respective rings, such as an upper rib 1296 of the first blade 1280 and an upper rib 1298 of the second ring 1284 are substantially coplanar while aligned with one another when assembled into the single blade subcomponent 1258.

Similarly, bottom or hub engaging surfaces, including a first hub engaging surface or flange 1330 of a first blade member 1280 and a second hub engaging surface or flange 1332 of the second blade member 1284 may also be substantially coplanar and/or aligned when the blade component 1258 is assembled.

Further the two blade subcomponents 1270 may be substantially identical and/or include respectively different offsets to ensure the alignment of the assembled component 1258. Nevertheless, the blade subcomponents 1270, 1274 may be formed in a single two plate mold including one core on a plate and one respective cavity in an opposing plate to form the respective subcomponents 1270, 1274. Thus, the respective blades may include the double curvature, as discussed above.

For example, the first blade member 1280 may include a first curvature 1340 along a face of the blade member 1280. The first curvature 1340 may be generally formed at an angle relative to a central axis 1344 of the impeller, similar to the central axis 1234. The blade 1280 may include a second curvature 1348 formed along an upper rib or ridge 1296 of the blade member 1280. Each of the respective blade components, including the second blade member 1284 may include a similar double curvature, as discussed above. Further the blade component 1258 may be fixed to the hub component 1154, or any appropriate hub component, and the shroud component 1160, or any appropriate shroud component in a manner similar to that discussed above, such as with sonic welding, heat melting, adhesives, or the like.

Turning reference to FIG. 21, FIG. 22, and FIG. 23, an impeller 1350 is illustrated. The impeller 1350 may for operated to rotate around an axis 1351. The impeller 1350 may include a hub component 1354, a blade component 1358, and a shroud component 1362 similar to the hub component 1154, blade component 1158, and shroud component 1160, discussed above. Similar details are not discussed in detail here, but are understood to be included if selected.

The blade component 1358 may be formed as two subcomponents including a first blade subcomponent 1370 and a second blade subcomponent 1374. The first blade subcomponent 1370 may include a plurality of blades or a selected number of blades, such as three blades. Accordingly, the first blade subcomponent 1370 may include a first blade 1380, a second blade 1382, and a third blade 1384. The second blade subcomponent 1374 may include a first blade 1390 and a second blade 1392. Accordingly, the two blade subcomponents 1370, 1374 may include different number of blades such as the first blade subcomponent 1370 includes three blades and the second blade subcomponent 1374 includes two blades. It is understood by one skilled in the art that any appropriate number of blades may be formed in each of the blade subcomponents and that the difference of one blade is merely exemplary. Therefore, it is understood that any appropriate number of blades may be formed into a blade subcomponent, whether a single blade subcomponent or a multiple part blade subcomponent.

The respective blades may be connected to central connection portions such as a first connection portion 1393 of the first blade subcomponent 1370 and a second connection portion 1394 of the second blade subcomponent 1374. The connection portions may be generally "C" shaped. The blade members may be generally formed as one piece with the connection portion, such as with a molding. The connection portions 1393, 1394 may include different dimensions, such as different curve or arc lengths, to allow for selective placement of the blade members of each blade subcomponent 1370, 1374. In various embodiments, different numbers of blade members may be included in each blade subcomponent 1370, 1374 and varying dimensions of the connection portions 1393, 1394 allow configuration of the blade component 1358.

The central connection portion 1393 may include two regions including a first region 1393*a* and a second region 1393*b* that may be different in a thickness such that a step 1393*c* is defined therebetween. The second central connection 1394 may also include a first region 1394*a* and a second region 1394*b* but also differ in thickness such as defined from a step 1394*c* therebetween. As discussed above, the respective steps 1393*c*, 1394*c* may allow for the respective blade components 1370, 1374 to be oriented relative to one another such that the first and second sides are upper and lower surfaces of the central connection may be substantially planar and form a central connection that is substantially annular 1370. Further, the blades may be offset relative to the central connection, such as the blade 1392 may extend a distance or have a portion that is offset from a bottom surface 1392*a* of the portion 1394*b* of the central connection 1394. Accordingly, a connection or connection portion 1392*b* extending from the blade 1392 may extend a distance 1395 from the bottom surface 1392*a* such that it overlaps the connection portion 1393 when formed into the single blade component 1358, as illustrated in FIG. 21.

The blade subcomponents 1370, 1374 allow for formation of a double curvature and/or at least two curves of each of the blades, such as the blade member 1392 forming a first curve 1397 along a face of the blade component 1392 and a second curve 1399 along a rib or ridge 1392*d*. Thus, the blade 1392 may form or define the two curves 1397, 1399 similar to the curves defined by the blades as discussed above. As also discussed above, the curves 1397, 1399, in various embodiments, may be defined with a constant respective radius or may be defined by selected varying radii. The blade subcomponents 1370, 1374 may include a double curvature along each of their blades. Further, the blade subcomponents 1370, 1374 may be formed in a two plate injection mold system or process, as discussed above. Thus, the impeller 1350 may include the blade component 1358 including the double curvature or dual curved blades that may be formed in a two plate injection mold system and process by forming the blade component 1358 from the two subcomponents 1370, 1374.

The blade component 1358 may be fixed to the hub component 1354 such as by fitting within a plurality of grooves 1398 formed therein. As discussed above, a rib engaging edge or surface 1402 of each of the blades may be placed into the groove 1398 and fixation mechanisms may be used such as sonic welding, heat melting, adhesives, or the like. Further, the blade component 1358 may be fixed to the shroud component 1362, such as by engaging in a plurality of grooves 1406 formed into the shroud component 1362. The shroud may be fixed to the blade component 1358 by various connection mechanisms such as sonic welding, heat welding, adhesive, or the like. The impeller 1350 may be fixed into a single unit, as discussed above.

Turning reference to FIG. 24, FIG. 25, and FIG. 26, an impeller assembly 1450 is illustrated. The impeller assembly may include components similar to those discussed above, such as a hub component 1454, a blade component 1458 and a shroud component 1462. The impeller assembly 1450 may rotate around a central axis 1466, particularly when it is connected to a shaft of the pump 20 or an appropriate pump.

The impeller assembly 1450 may be formed as a plurality of components individually, such as the hub component 1454, the shroud component 1462, and the blade component 1458. As discussed above, the blade component 1458 may be formed of a plurality of members. As illustrated in FIG. 26, the blade component 1458 may include seven individual blade members, such as a first blade member 1470. Each of the blade members of the blade component 1458 may be substantially identical to one another. Accordingly, discussion of the blade component 1470 it is understood to relate to all of the blade members of the blade component 1458.

Each of the blade members, such as the blade member 1470, may include a hub engaging portion or flange 1474 from which at least one or a plurality of stakes may extend, such as a first stake 1476 and a second stake 1478. The flange 1474 may also extend at an angle relative to a face of the blade to assist in rigidity of the blade member.

The hub engaging surface 1474 may be received in a groove 1482 of the hub 1454 that may be formed between at least two walls. The two walls may include a first wall 1484 and a second wall 1486. One of the respective walls, such as the first wall 1484, may form an undercut or an overhang to engage the hub engaging surface 1474. Further a bore or through bore, including a first through bore 1488 and a second through bore 1490 may receive the respective pegs or projections 1476, 1478. The projections received in the through bores 1486, 1490 may assist in fixation or connection of the individual blade members, such as the first blade member 1470, to the hub assembly 1454. For example, the pegs 1478, 1476 may be sonically welded or heat staked to the hub 1454 after being received through the bores 1486, 1490. In addition and/or alternatively thereto, selected adhesives or other appropriate materials may be used to fix the blade member 1470 to the hub member 1454.

The hub component 1454 may be generally frustoconical in shape between a base 1500 and an upper region or portion 1504. Extending from the upper region 1504 may be a tapered shaft or cylindrical portion 1506. The groove 1482 may be formed and extend along the frustoconical surface of the hub component 1454. The hub engaging surface 1474 of the blade component 1470 may have a complimentary shape such that a portion of the flange 1474 near the second peg 1478 extends a distance further from a plane 1508 than a portion of the flange 1474 near the first peg 1476. Accordingly, the blade member 1470 may also include an upper rib or surface 1512 that has a similar configuration. Accordingly, the blade member 1470 may mate with the groove 1482 of the hub component 1454 to form the blade component 1458.

Further, the blade component 1470 may include a double curve or radius, as discussed above. For example, a first face or surface 1514 may include a first curve or radius 1516. The upper rib 1512 may include or define a second radius or curve 1518. The first curve 1516 may generally be formed at an angle perpendicular to the long axis 1466 and the second curve 1518 may be formed around or radially around the long axis 1466. Nevertheless, the blade member 1470 may include the double curve or double radius, as discussed above.

In various embodiments, the shroud 1462 may be fixed to the blade component 1458 as discussed above. For example various adhesives, sonic welding, heat welding or the like may be used to connect the shroud 1462 to the blade component 1458. Accordingly, one or more of the blades 1470 may be connected to either or both of the hub components 1454 and/or the shroud component 1462. As illustrated in FIG. 24, the impeller assembly 1450, when assembled with the shroud component 1462, may include an inlet area or region 1530 and an outlet through an opening or annular opening 1534 of the shroud component 1462.

Turning reference to FIG. 27 through FIG. 30, an impeller 1550 is illustrated. The impeller 1550 may include components similar to the impeller 1450, as discussed above, and therefore similar portions will not be repeated in detail or may be discussed briefly. Generally, the impeller 1550 includes a hub component 1554, a blade component 1558, and a shroud component 1562. As illustrated in FIG. 27, the impeller 1550 may be assembled around a central or longitudinal axis 1566 around which the impeller 1550 may rotate. In various embodiments, the impeller 1550 may include an outlet 1568 and an inlet 1570 which may be through the shroud 1562. It is understood, however, that the inlet and the outer in operation may be dictated by the direction of rotation of the impeller 1550.

The impeller assembly 1550, as illustrated in FIG. 28, may include a multicomponent or subcomponent hub assembly 1554 including a cap member or portion 1572 and a hub component 1576. The cap component 1572 may generally be a frustoconical shape extending from a base 1580 to a top portion or surface 1582. Formed through the cap member 1572 may be a bore 1584 that may receive a shaft 1588 of the hub member 1576. The cap portion 1572 may further include a plurality of bores, including a first bore 1592 formed generally around an outer circumference near the base 1580. Near the top 1582 may be a plurality of depressions or grooves 1594. It is understood that the bores 1592 may be through bores or blind bores and that the grooves 1594 may also be through grooves or blind grooves formed into the cap 1572.

The cap 1572 at the top 1582 forms or defines a surface 1596. The surface 1596 may mate and/or be fixed to the hub member 1576, such as with a sonic welding due to an energy director 1598 formed by the or on the hub member 1576. The hub member 1576 may further include a plurality of radially and/or spirally extending members or fingers 1602. Each of the fingers 1602 may include a pin or projection 1604. The projections or pins 1604 may be received into selected numbers of the bores 1592 of the cap 1572. As illustrated in FIG. 28, the pins 1604 may alternate with individual or separate blade members, such as a blade member 1608 and a second blade member 1610. The finger 1602 may be positioned between the two blade members 1608, 1610. Accordingly, each of the fingers 1602 may be positioned between respective blade members of the blade component 1558.

The blade members 1610 may further include selected pins, such as a first pin 1614 of the first blade member 1608 and a second pin 1616 of the second blade member 1610. The pins 1614, 1616 may be received in respective or selected bores 1592 of the cap 1572. As discussed above, and illustrated in FIG. 28, the pins 1614, 1616 of the respective blades 1608, 1610 may be fixed into alternate bores 1592 adjacent to the bore received the pin 1604.

Further, each of the blades may include a step or projection including a first step 1620 of the first blade 1608 and a second step 1622 of the second blade 1610. The steps 1620, 1622 may be elongated to provide a selected surface are to receive in respective grooves 1594 of the cap 1572. The interaction of the pins 1614 and projections or step 1620 in combination with being received in a void or space 1630 between respective ones of the fingers 1602 of the hub member 1576 may hold the respective blades, such as the first blade 1608, relative to each other and the hub member 1576 and the cap 1572.

In addition thereto, or alternatively thereto, the hub member 1572 may define grooves in an upper surface 1628. Respective grooves may form or define or be defined by walls that extend into the cap 1572 to assist in holding or fixing the blade members, such as the first blade member 1608 in a selected position. Nevertheless, the pins, such as the pins 1614, 1616 are fixed to the cap 1572 in a selected manner, such as with sonic welding, heat welding, adhesives, or the like. Further, the hub member 1576 may be fixed to the cap 1572 to assist in holding the blade members, such as the first blade member 1608 in a selected position.

The blade component 1558 may include a plurality of blade members such as the first blade member 1608 and the second blade member 1610, similar to the blade component 1458 as discussed above. The hub component 1554, however, may be formed as the two members including the cap 1572 and the hub member 1576. Nevertheless, the individual blade members may be formed to include selected geometry including a hub engaging surface or flange 1634 of the first blade member 1608, from which the pin 1614 and the projection 1620 extend, may have a selected distance from a plane 1636. As discussed above, the portion of the surface 1634 near the pin 1614 may be closer to a plane 1636 than the portion of the surface 1634 near the projection or step 1620. As the cap 1572 may include a first conical surface 1628, the flange 1634 may include a complementary shape such that an upper rib 1640 may include a selected configuration in the assembled format.

In various embodiments, forming each of the plurality of blades, such as the first blade 1608 and the second blade 1610, separately from one another allow a substantially overlapping configuration, as illustrated in FIG. 30, to be formed with the plurality of blades assembled together in the impeller assembly 1550, as illustrated in FIG. 27. Each of the blade members, however, may include a selected double curvature, as discussed above. For example, the first blade 1608 may include a first curve or arc 1644 defined by a first face 1646 of the blade 1608. The upper rib 1640 may define a second curve 1650. Accordingly, the blade 1608 may include a double curve or double radius configuration, as discussed above. Each of the blade members of the blade component 1558 may include a selected double curved design.

Moreover, each of the blade members of the blade component 1558 may be substantially identical to one another. Accordingly, a plurality of the blade members may be formed in a single mold or mold design and assembled together into the impeller assembly 1550. The mold assembly may be a two plate mold assembly including a core and an opposing recess or cavity to form the single blade member, such as the blade member 1608.

The final impeller configuration may be formed by positioning together the plurality of blade members of the blade component 1558 in addition to the hub component 1554 including the hub member 1576 and the cap 1572. During assembly, the blades, such as the blade 1608, may get trapped between the hub subcomponent 1576 and the cap subcomponent 1572 that are fixed together, such as by welding via the energy director 1598 and heat stake pins 1604. Thus, the blades may be captured between the hub subcomponent 1576 and the cap subcomponent 1572 and/or fixed to the shroud 1562 and the cap 1572 such as by welding and/or adhesives.

The blade component 1558 may further be fixed to the shroud 1562 through selected mechanisms, such as through sonic welding, heat welding, adhesives, or the like. The connection may be by engagement of an inner surface 1652 with the upper rib 1640 of the blade members of the blade component 1558. The shroud 1562 may define selected grooves, as discussed above, or may have a substantially smooth surface as illustrated in FIG. 28. The rib, as discussed above, may include a selected energy director.

With reference to FIG. 31 and FIG. 32, an impeller 1750 is illustrated. The impeller 1750 may include components similar to those discussed above, including a hub component 1752, a blade component 1776, and a shroud 1758. The impeller assembly 1750 may include components similar to the hub assembly 1550, as discussed above, and like similar features will not be repeated in detail here.

The hub component 1752 may be formed of two subcomponents including a cap component 1762 and a hub component 1766. The cap component 1762 may be generally frustoconical extending from a base 1770 to a top 1774. The cap 1774 may include an upper surface 1776 that may be fixed to the hub subcomponent 1766, as discussed above regarding the hub component 1576 connecting to the cap 1572. For example, the hub component 1766 may include an energy director 1777 to assist in sonic welding of the hub component 1766 to the cap component 1762. It is understood that other appropriate connection mechanisms or systems may be used such as heat welding, adhesives, or the like. Accordingly, the hub component 1766 may be fixed to the cap component 1762.

The cap component 1762 may include an upper or contact surface 1780. The upper surface 1780 may include, according to various embodiments, one or more grooves extending radially from a central or longitudinal axis 1782 toward an outer edge 1784 of the base 1770. The grooves may receive one or more fingers 1788 of the hub component 1766. The fingers 1788 may extend radially and along a curved line from a central post or shaft 1790. The shaft 1790 may be generally columnar in configuration and extend through the hub component 1766. The shaft component 1790 may include a portion that extends through a bore or opening 1792 defined through the cap 1762. The surface 1780, if it includes a groove, may engage the fingers 1788 of the hub component 1766.

Further the upper surface 1780 may include elongated grooves 1798 that extend around a circumference of the base 1770 of the cap component 1762. The elongated grooves 1798 may receive a snap or step 1802 defined by or extending from a hub engaging surface or flange 1804 of a blade member, such as a first blade member 1810 of the blade component 1776. The step 1802 may engage the groove 1798 to assist in holding the blade member 1810 relative to the cap 1762. Further, the blade member may be positioned through and/or engaged adjacent fingers, such as the finger 1788 and a second finger 1814 of the hub component 1766. Between the fingers 1788, 1814 may be a space or void 1818 into which the blade member 1810 may be positioned. The blade may slide in a dovetail groove created between the hub subcomponent 1766 and the cap subcomponent 1762 until a snap fit occurs between the snap 1802 and the groove 1798. Further, the blade member may be fixed to the cap 1762 due to sonic welding, heat welding, adhesives, or the like. In various embodiments, the projection 1802 may be an energy director to assist in sonically welding the blade member 1810 to the cap 1762 at the groove 1798. It is understood that the blade component 1776 may include a plurality of the blades 1810 and each may include similar or identical features.

Further, each of the blade members of the blade component 1776 may be substantially identical. Accordingly, a plurality of the blade members may be formed separately and individually and incorporated into the single blade component 1776. Each of the blade members may include selected dimensions and geometry, such as a double curvature.

As discussed above, each of the blade members, such as the first blade member 1810, may include a multiple curve, such as a two curve configuration. In various embodiments, a first curve 1822 may be formed or defined by a first face or surface 1826 of the blade 1810. An upper ridge 1828 may form or define a second curve or radius 1832. Accordingly, the blade member 1810 may include a dual curve or dual radius configuration, similar to the blade members discussed above. Again each of the blade members, such as the first blade member 1810 may be substantially identical. Also, the blade component 1776 and may be formed in a two plate injection mold system including a single core and a single cavity for forming the blade 1810. The blade members may be interconnected with the hub component 1766 and the cap 1762 to form the impeller 1750.

Further the blade component 1776 may be fixed or connected to the shroud 1758, such as by contacting or being fixed to an inner or upper surface 1840 of the shroud 1758. The blade members of the blade component 1776 may be fixed to the inner surface 1840 similar to a manner as discussed above such as with sonic welding, heat welding, adhesives, or other appropriate connection mechanisms. The shroud 1758 may further include an outer or exterior surface 1842. Accordingly, the impeller 1750 may be formed of the plurality of components being formed together as a single impeller assembly, as discussed above.

With reference to FIG. 33, FIG. 34, and FIG. 35 an impeller 1950 is illustrated. The impeller 1950 may include components similar to the components of the impeller 1750, discussed above. Accordingly, similar components will not be described in detail however differences of their frame will be discussed. The impeller 1950 may include a hub component 1952, a blade component 1954, and a shroud 1962. Similar to the hub component 1752 discussed above, the hub component 1952 may include two portions including a cap subcomponent 1970 and a hub subcomponent 1974. The blade component 1954 may include a plurality of blade members that may be each substantially identical, such as a first blade member 1976 and a second blade member 1978. In an assembled format, as illustrated in FIG. 33, the cap component 1970 may be coupled to the hub component 1974 such as at projections or risers 1982. The risers 1982 may engage a bottom surface or portion 1984 of the hub subcomponent 1974. The cap subcomponent 1970 may be fixed to the hub subcomponent 1974 through appropriate mechanisms such as sonic welding, heat welding, adhesives, or the like as discussed above.

Between a plurality of the projections 1982 may be voids or spaces 1988. The voids 1988 may capture a cap engaging portion or projection 1990 of the blade members of the blade component 1954, such as the first blade member 1976. Accordingly, at least a first or outer edge of the blade component 1954 may be captured between the cap component 1970 and the hub subcomponent 1974.

The blade members, such as the second blade member 1978, may include a hub engaging surface or flange 1994 that may contact or be held within a groove 1996 defined by the hub subcomponent 1974. The groove 1996 may be defined between a first wall 1998 and a second wall 2002. The two walls 1998, 2002 may engage the blade component 1978 while the hub engaging surface 1994 of the blade component 1978 may engage or be held against a bottom surface 2004 of the groove 1996.

Further the hub subcomponent 1974 may include an inner or upper engaging or capture region 2010. The hub subcomponent 1974 may be substantially frustoconical in configuration extending from a base 2012 to an upper portion, such as an upper portion 2014. The capture region or void 2010 may be generally formed near the upper region 2014. The blade 1978, as with all of the blades the blade subcomponents 1954, may include a projection or finger 2018. The projection 2018 may be received within the void 2010 defined by the hub subcomponent 1974. Thus, a second end of the blade 1978, and all of the blade members of the blade component 1954, may be captured at one end with the finger 2018 and a second end with the cap engaging portion 1990. The blade component 1954, including the individual blade members, therefore, may be fixed relative to the hub subcomponent 1974 with at least two mechanical connections formed by projections of the blade members. In various embodiments, the cap component 1970 may be fixed to the hub component 1952 prior to placing the blades, such as the blade 1974. Thus, the blades may slide and be captures with both the clip 1990 in the void 1988 and the projection 2018 in the void 2010, substantially simultaneously. Additionally, and/or alternatively, additional fixation may occur, such as welding and/or adhesives.

The hub subcomponent 1974 may further include or define a central extension or shaft 2020. The shaft 2020 may define or form a central bore 2022. The central bore 2022 may be defined around a long axis or axis of rotation 2024 of the impeller 1950. Accordingly, as illustrated in FIG. 33 in various embodiments, during operation the impeller 1950 may have an outlet 2026 and an inlet 2028 through the shroud 1962. It is understood, however, that the inlet and the outlet may be defined by the direction of rotation of and/or the flow through the impeller 1950.

The blade subcomponent 1954 may be fixed to the shroud 1962, such as to an internal surface 2030. The shroud may also have an exterior surface 2032. In various embodiments, as discussed above, each of the blade members of the blade subcomponent 1954 may be fixed to the internal surface 2030 of the shroud 1962. The blade subcomponent 1954 may be fixed with selected fixation mechanisms or techniques such a sonic welding, heat welding, adhesives, or the like. Accordingly, the impeller 1950 may be formed together as a single unit from a plurality of individual pieces, as illustrated in FIGS. 33-35.

Moreover, the blade subcomponent 1954 may be formed of a plurality of individual blade members, as illustrated in FIG. 35. Each of the blade members may be substantially identical to one another. Moreover, each of the blade members may be formed in a two plate mold or injection mold including a cavity portion and a core portion. The blade members may each include a dual curvature, similar to the dual curvature as discussed above. Each blade member may include a first curve 2040 formed or defined by a face portion 2042 of the blade member, such as the blade member 1978. Further each of the blade components may include or define a second curve 2044 by an upper rib or upper surface 2046. As discussed above, the second curve 2044 may be substantially around the central axis 2024 while the first curve 2040 may intersect the axis 2024.

Accordingly, an impeller assembly may be formed of individual portions, as discussed above, that provide for an overlapping or non-overlapping blade subcomponent where each of the blade members may include a dual curvature relative to two planes. Each of the blade components may be formed to include a dual curvature by an injection mold in process where the blade member is injection molded between two plates where a single plate includes a core and a single plate includes a cavity. The configuration of the blade members, as discussed above according to various embodiments, however, may be formed in a single two plate injection mold system without requiring additional slides or complex moving portions. The plurality of blade members may be interconnected, as discussed above, to form the impeller assembly including the dual curvature of blade subcomponents for forming the pump 20 to include a selected pressure and/or flow efficiencies at selected impeller diameters, power ratings of a motor powering the pump 20, or other features.

Each blade, as discussed herein, may include a duel curvature or duel arc. The duel curve may also be referred to as a double curvature. It is understood that multiple curves, including more than two curves, may also be defined by the blade members. Generally, at least on curve or arc is perpendicular to the long axis of the impeller and may generally be formed in a plane with or parallel with the long axis. Another arc or curve may generally be formed in a plane perpendicular to the long axis. As discussed herein, various blade components may have blades with a double curvature similar to that discussed above.

The individual components, including the hub and blade components, according to selected embodiments, may be fixed together in a substantially sealed manner. Thus, hydraulic efficiency and power of the impeller may be maintained and/or enhanced by eliminating or decreasing non-selected flow paths. Also, the blade members may each include the hub engaging flange or surface, as discussed above, that extends substantially non-parallel (including about 50 degrees to about 90 degrees) from a face surface of the blade members.

Further, each of the impellers may be provided in combination in a phase or section of a pump, such as with a selected diffuser. A diffuser may be substantially non-rotating relative to the pump casing while the impeller may rotate relative to the pump casing. The diffuser may be formed of a similar geometry or components, as discussed above, to operate in tandem or concert with the selected impeller. It is further understood that a pump, such as the pump 20 may include one or a plurality of sets of the impellers and/or diffusers in combination for operation. Moreover, the impeller, according to various embodiments, may be used with any selected configuration, such as with a volute system including the FACT pump system sold by Franklin Electric Co., Inc. having a place of business at Fort Wayne, Ind. 46809.

A pump, including the portions, such as an impeller as described herein, may have significantly higher hydraulic efficiency, without increasing the tooling and manufacturing cost of the impeller. The various components may be sealed together (e.g. with adhesives, welding, physical interconnections (e.g. dovetail)) to reduce or eliminate fluid leakage.

The shape and configuration of the blade components may also be selected, including double curvature to achieve selected fluid flow characteristics. Moreover, as noted above, the selected double curvature may be defined by variable or varying radius. Thus, a single one of the curves defined by any of the blade members may not have a constant radius over the extent of the curve.

With reference to FIG. 36, a mold assembly 2300 is illustrated. The mold assembly 2300, may be an efficient two-plate mold assembly including a first plate 2310 and a second plate 2320. As discussed above, the first plate 2310 may include a core 2328 and the second plate 2320 may include a cavity 2332. Accordingly, the mold assembly 2300 may include the two plates 2310, 2320 to form the components, as discussed above. The various geometries of the individual components, as discussed above, may be formed in the two-plate mold 2300 such that additional slides and inserts are not necessary to achieve a selected geometry.

Further, the various components, such as a multi-blade blade component or a two-blade blade component (e.g. where each blade subcomponent includes a plurality of blades) may be formed in the mold assembly 2300. It is understood that the specific geometry of the core 2328 and the cavity 2332 may be based upon the selected geometry of the individual blade or blade subcomponents.

Further, it is understood that a mold assembly 2300 may include various portions, such as an ejector pin or member 2340, injection ports, cooling channels 2344, and other components. Various mold assemblies may be automated or partially automated to assist in manufacturing a plurality of components. During operation, the material to form the blade or blade component may be injected through injection ports and form a layer of material 2348 (e.g. plastic) over the core 2328. Once the mold is opened (e.g. the core 2328 is moved away from the cavity 2332) the plastic 2348 may be removed from the mold 2300. One skilled in the art will understand that the mold assembly 2300 may be altered to include more or less portions depending upon the specific automation of the mold assembly. Nevertheless, the components, as discussed above, including the blade components and subcomponents, may be formed in a mold assembly that includes the two plates 2310, 2320 without additional components to interact with the formation of a specific geometry of the blade components.

With reference to FIG. 3B, and generally to the various components discussed herein including various blade, hub, or shroud components, it is understood that the various components may be molded with an efficient mold configuration that may also be referred to as a simple mold assembly. The simple mold assembly may be similar to or include a simple two plate mold assembly as illustrated in FIG. 36. Generally, the mold assembly may mold a selected portion or component without any undercuts, inserts, or rotational mold pieces.

As discussed above, and as schematically illustrated in FIG. 3B, the blade component 158 may be molded in a two plate mold where each portion of the blade assembly may be contacted by a portion of the mold, such as either the cavity 2332 or the core 2328, that meet at the parting line 260 that may be a line on a surface of the components, such as the blade component 158. When the mold assembly is opened, the mold assembly may be opened in a substantially axial direction, such as generally along the axis 2500, as illustrated in FIG. 36, such that the joining plane or parting line 260 may be substantially along a surface of the mold assembly 2300. Thus, a surface or face of the component and/or edge of a component (e.g. faces of the blade members 210 and/or the blade extension 178) are not covered or are exposed along the axis 2500. The mold assembly 2300 may, therefore, be drawn apart along the axis 2500, in the direction of one or more of the arrows 2260*a*, 260*b*, and each of the surfaces of the selected component, such as the blade component 158 are exposed along the axis 2500. The components, including the blade component 158, may also be withdrawn from the mold assembly 2300 also generally along the axis 2500.

In other words, the mold portions, such as the plates 2310, 2320 may be drawn away from the component, such as the blade component 158 along the axis 2500. The blade component 158 (or other appropriate component), therefore, includes the mold plates moved away from the blade component generally along ray lines 260*a*, 260*b*. Moreover, the blade components, such as the surfaces thereof, are substantially free or without obstruction of another portion of the blade component along the rays 260*a*, 260*b* extending from the surfaces.

The mold assembly 2300 may engage the components and the surfaces of the components may be formed by substantially only axial movement of the mold assembly 2300 along the axis 2500. The blade components, or any selected component as discussed above, may be formed in the mold assembly 2300 in such a manner such that each face or surface is exposed during the axial draw or movement of the mold assembly 2300 along the axis 2500. As discussed above, the blade component may be formed including a selected number of blade members to form the configuration to allow for the axial draw of the mold assembly. In various embodiments, the plurality of components may include a plurality of blade subcomponents that may be assembled into a single blade component. Further, the blade component may be formed separately from any other components, such as a shroud or hub component, as discussed above. A final assembly, such as an impeller, therefore, may be formed from connection or coupling of multiple members and/or components.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An impeller for a pump assembly, comprising:

a separate hub component;

a separate blade component having at least one blade that has a double curvature fixed to the separate hub component; and a separate shroud component;

wherein both of the separate hub component and the separate shroud component are configured to be united with the separate blade component;

wherein the double curvature includes a first curve in a first plane and a second curve in a second plane.

2. The impeller of claim 1, wherein the separate blade component includes a plurality of blade members connected to a central connection portion;

wherein the plurality of blade members is formed as one piece with the central connection portion;

wherein each blade member of the plurality of blade members includes the double curvature.

3. The impeller of claim 2, wherein the plurality of blade members includes a first plurality of blade members having a number of blade members different than a second plurality of blade members.

4. The impeller of claim 1, wherein the separate blade component having the double curvature includes the first curve extending substantially radially and around a long axis of the impeller and the second curve extending generally perpendicular to the long axis of the impeller.

5. The impeller of claim 4, wherein the separate blade component includes a plurality of blade members;

wherein each blade member of the plurality of blade members includes the first curve and the second curve;

wherein the plurality of blade members are formed as a unitary members as the separate blade component.

6. A pump assembly, comprising:

a casing operable to be fixed in a first position;

a shaft operable to be rotated relative to the casing;

an impeller rotatably mounted within the casing, wherein the impeller comprises separately a blade component and a hub component configured to be fixed together; and a diffuser fixed relative to the casing;

wherein the blade component comprises a first separate blade subcomponent having at least a first blade member having a first curve in a first plane and a second curve in a second plane and a second separate blade subcomponent having at least a second blade member having a third curve in the first plane and a fourth curve in the second plane;

wherein the first separate blade subcomponent and the second separate blade subcomponent are configured to be assembled as a unified blade assembly.

7. The pump assembly of claim 6, wherein the first plane is parallel with a plane of a long axis of the shaft and the second plane is at an angle relative to the plane of the long axis of the shaft.

8. The pump assembly of claim 6, wherein the first separate blade subcomponent includes a first plurality of interconnected blade members and the second separate blade subcomponent includes a second plurality of interconnected blade members.

9. A pump assembly, comprising:

a casing operable to be fixed in a first position;

a shaft operable to be rotated relative to the casing;

an impeller rotatably mounted within the casing, wherein the impeller comprises separately a blade component and a hub component configured to be fixed together; and a diffuser fixed relative to the casing;

wherein the blade component includes at least a first blade member having a first curve in a first plane and a second curve in a second plane;

wherein the blade component comprises a plurality of blade members;

wherein the plurality of blade members are individually fixable within a face recess of the hub component and to the hub component including at least a first protrusion configured to be received in a complementary recess of the hub component.

10. The pump assembly of claim 9, wherein the each blade member of the plurality of blade members includes a face surface and a flange extending at an angle relative to the face surface;

wherein the flange is operable to be captured by the face recess of the hub component.

11. The pump assembly of claim 10, wherein the face recess of the hub component further comprises a first groove formed into a first surface;

wherein the flange is captured in the first groove.

12. A pump assembly, comprising:

a casing operable to be fixed in a first position;

a shaft operable to be rotated relative to the casing;

an impeller rotatably mounted within the casing, wherein the impeller comprises separately a blade component and a hub component configured to be fixed together; and a diffuser fixed relative to the casing;

wherein the blade component includes at least a first blade member having a first curve in a first plane and a second curve in a second plane;

wherein the blade component further comprises a pin and the hub component further comprises a through bore;

wherein the pin is received within the through bore.

13. A method of forming an impeller for a pump assembly, comprising:

forming a hub component;

forming a blade component separate from the formed hub component, wherein the blade component includes (i) a central member extending along an axis and (ii) at least one blade member that extends radially from the central member;

forming a shroud component; and fixing together the blade component to the hub component and the shroud component;

wherein at least prior to the fixing together the blade component and the hub component the at least one blade member extends radially from a central axis and has a free edge away from the central axis;

wherein fixing together the blade component and the hub component comprises at least one of sonically welding, heat melding, adhering, or combinations thereof the blade component with the formed hub component.

14. A method of forming an impeller for a pump assembly, comprising:

forming a hub component;

forming a blade component separate from the formed hub component at least two double curvature blades at the overlap; and fixing together the blade component and the hub component;

wherein the forming the blade component, comprises:

injection molding the double curvature blade in a cavity of a first plate of a two-plate mold relative to a core of a second plate of the two-plate mold;

wherein the double curvature includes a first curve in a first plane and a second curve in a second plane.

15. The method of claim 13, wherein forming the blade component comprises forming a plurality of the first blade member and a plurality of the second blade member;

wherein fixing together the blade component and the hub component includes fixing both the first blade member and the second blade member to the hub component.

16. The method of claim 14, further comprising:

only drawing apart the first plate and the second plate to access the formed blade component.

17. A method of forming an impeller for a pump assembly, comprising:

forming a hub component;

forming a blade component separate from the formed hub component; and fixing together the blade component and the hub component;

wherein at least prior to fixing together the blade component and the hub component the blade component extends radially from a central axis and has a free edge away from the central axis;

wherein fixing together the blade component and the hub component comprises fitting a flange of the blade component into a groove formed in the formed hub component;

wherein the blade component includes a blade member that has a double curvature that includes a first curve in a first plane and a second curve in a second plane.

18. An impeller for a pump assembly, comprising:

a plastic blade component, wherein the blade component has a blade member that defines a first curve in a first plane and a second curve in a second plane;

a shroud component;

wherein the first plane and the second plane intersect;

wherein the blade component is fixable to the shroud component;

wherein the blade member is configured to be formed in a mold assembly having a first plate and a second plate, wherein the mold assembly is configured to be drawn apart along an axis to release the blade member and the blade member is configured to be the unobstructed by another portion of the blade component along a ray extending from a surface of the blade member.

19. The impeller of claim 18, wherein the shroud component is an inlet shroud or an outlet shroud.

20. The impeller of claim 18, further comprising:

an inlet shroud component;

wherein the shroud component is an outlet shroud component;

wherein the blade component is fixed to both the inlet shroud and the outlet shroud.

21. The impeller of claim 20, further comprising:

a motor operable to rotate the blade component.

22. The impeller of claim 18, further comprising:

a second plastic blade component, wherein the second blade component has a second blade member that defines a third curve in a third plane and a fourth curve in a fourth plane;

wherein the blade component and the second blade component are configured to be coupled to the shroud component.

23. The impeller of claim 22, wherein a ray extending from a surface of the blade member is obstructed by the second blade member.

* * * * *